US012187390B2

(12) United States Patent
Reh Aguirre De Carcer

(10) Patent No.: US 12,187,390 B2
(45) Date of Patent: Jan. 7, 2025

(54) HYDROFOIL ATTACHMENT SYSTEM AND METHOD

(71) Applicant: Pacific Tradewinds, LLC, Wheat Ridge, CO (US)

(72) Inventor: Jaime B. Reh Aguirre De Carcer, Honolulu, HI (US)

(73) Assignee: Pacific Tradewinds, LLC, Wheat Ridge, CO (US)

( * ) Notice: Subject to any disclaimer, the term of this patent is extended or adjusted under 35 U.S.C. 154(b) by 509 days.

(21) Appl. No.: 17/651,234

(22) Filed: Feb. 15, 2022

(65) Prior Publication Data

US 2022/0258838 A1 Aug. 18, 2022

Related U.S. Application Data

(60) Provisional application No. 63/200,134, filed on Feb. 16, 2021.

(51) Int. Cl.
*B63B 32/66* (2020.01)
*B63B 1/24* (2020.01)

(52) U.S. Cl.
CPC ..... *B63B 32/66* (2020.02); *B63B 1/242* (2013.01)

(58) Field of Classification Search
CPC ..... B63B 32/66; B63B 1/242; B63B 32/51; F16B 7/20; F16B 7/22
See application file for complete search history.

(56) References Cited

U.S. PATENT DOCUMENTS 5,062,378 A * 11/1991 Bateman ..... B63B 32/64 441/74
9,586,651 B2 * 3/2017 Modica ..... B63B 32/66
2021/0047008 A1 * 2/2021 Reh Aguirre De Carcer ..... B63B 32/77

FOREIGN PATENT DOCUMENTS

DE 102021119503 A1 * 2/2022 ..... B63B 32/66

* cited by examiner

*Primary Examiner* — Anthony D Wiest
(74) *Attorney, Agent, or Firm* — Knobbe Martens Olson & Bear LLP

(57) ABSTRACT

The disclosure includes systems, assemblies, sub-assemblies and methods for removably and securely attaching a hydrofoil to a board used in water sports. At least some of the systems include toolless removable attachment. In various embodiments, the attachment a hydrofoil adaptor mechanically attached to a trench frame by one or more toolless locking assemblies.

9 Claims, 25 Drawing Sheets

HYDROFOIL ATTACHMENT SYSTEM AND METHOD

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims priority to U.S. Provisional Application No. 63/200,134, filed Feb. 16, 2021, titled "HYDROFOIL ATTACHMENT SYSTEM AND METHOD," which is hereby incorporated by reference in its entirety herein.

BACKGROUND

Field

The present disclosure relates generally to hydrofoils, and more specifically, to a hydrofoil assembly system for ease in mechanically mating a hydrofoil to a surfboard.

Hydrofoils

Hydrofoils generally are surfaces that interact with water as those surfaces are propelled forward. Hydrofoils include a wing or multiple wings mounted on a strut or multiple struts that position the wing or wings in the water. In some designs, the wing or wings interact with the water at speed to create lift, often reducing some or all of a hull or board surface from the water; thereby decreasing water drag resistance. This decrease leads to some or all of better efficiency, additional speed, and/or smoother rides. Designers attach hydrofoil(s) or foil(s) to boats, personal watercraft, surfboards, kiteboards, windsurfing boards, and the like.

SUMMARY

One challenge of hydrofoil systems is the difficulty in changing the various components after assembly of the hydrofoil, particularly the complexity, time, and needed tools for changing from one hydrofoil to another, or one strut to another. For example, hydrofoils attached to surf boards may be integrated into a single nonremovable attachment system in an attempt to ensure sufficient strength in the mechanical connection and/or simplification of manufacturing processes.

In other hydrofoil attachment systems, the hydrofoil may be attached to a surfboard by removable bolts, by one or many mortise and tenon structures, or using a track box with screws as fasteners. Examples of this and additional types of attachment systems are disclosed in U.S. Pat. No. 5,062,378, filed Nov. 16, 1989, and titled, "Hydrofoil and Surfboard Type Assembly." Another example is disclosed in U.S. Pat. No. 9,586,651, filed Jun. 16, 2015, titled, "Universal Hydrofoil Connector System and Method of Attachment." This patent references on its cover a priority benefit of Mar. 14, 2013. Each of the foregoing patent disclosures should be read in their entirety as the foregoing reference to each made herein was not a comprehensive, exhaustive, or even representative summary of scope or content of each disclosure.

The systems and methods of use described in the present application overcome one or more of the above-discussed problems commonly associated with conventional hydrofoils, improve the aesthetics, and/or provide straightforward and/or convenient operation and use. These and other unique features of the systems and methods of use are discussed below and illustrated in the accompanying drawings.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Figure 1:
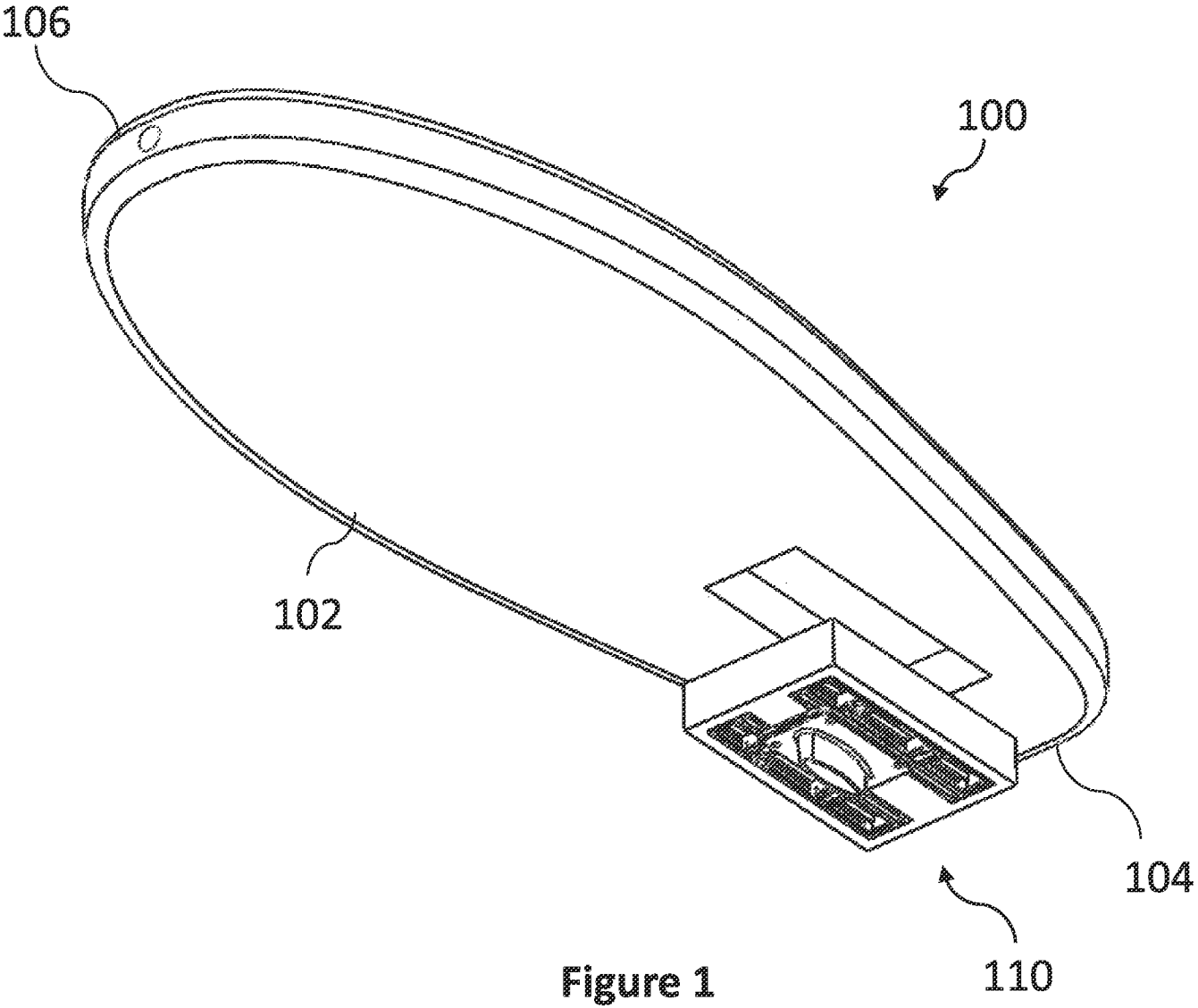
FIG. 1 illustrate a surfboard with an exemplary foil attachment assembly.

FIG. 1 illustrate a surfboard 100 with a foil attachment assembly 110 on a first or bottom side 102 of the surfboard 100. The bottom side 102 of the surfboard 100 faces the water in use. The foil attachment assembly 110 may be closer to a rear end 104 of the surfboard 100 than a front end 106 of the surfboard. As shown in FIG. 1, the foil attachment assembly 110 may be at least partially embedded within the surfboard 100. For example, the foil attachment assembly 110 be embedded within the surfboard 100 such that a bottom surface of the foil attachment assembly 110 is flush with the bottom side 102 of the surfboard 100. FIG. 1 shows the foil attachment assembly 110 with a foil plate already affixed to the assembly 110. When affixed, the foil plate may project from the bottom side 102 of the surfboard 100 to enable connection to other hydrofoil components. The foil attachment assembly 110 described herein is compatible with at least the hydrofoil described in U.S. application Ser. No. 17/651,228, filed on the same day as the present application, titled "HYDROFOIL," which is incorporated by reference in its entirety herein. Although the foil attachment assembly 110 is described with respect to a surfboard, the foil attachment assembly 110 can be attached to any board configured for water sports, for example kiteboards or windsurfing boards. Moreover, the foil attachment assemblies described herein may include any features of the foil attachment assemblies described in U.S. Publication No. 2021/0047008, filed Aug. 13, 2020, titled "HYDROFOIL ATTACHMENT SYSTEM AND METHOD," which is hereby incorporated by reference in its entirety herein.

FIGS. 2A-2F illustrate exemplary details of the foil attachment assembly 110 shown in FIG. 1. It may be desirable to connect the hydrofoil at different positions relative to a center of gravity of a surfboard 100. Accordingly, the foil plate 140 may be attached at multiple installation positions. For example, the foil attachment assemblies 110 illustrated herein may accommodate at least two installation positions (see FIGS. 2E and 2F). Different installation positions may provide the surfer with different amounts of lift depending on the position and/or power of the waves. When the hydrofoil is mounted closer to the front end 106 of the surfboard 100, the surfer will get more lift when the waves are small or the surfer travels downwind. When the hydrofoil is mounted closer to the rear end 104 of the surfboard 100, the surfer will get less lift but more control, which may be desirable when the waves are bigger. Although the foil plate 140 is shown with two installation positions, the foil attachment assembly may be designed with more than two positions, for example, at least four positions, at least eight positions, at least twelve positions, at least sixteen positions, at least twenty-four positions, or more. The installation positions may be separated by no more than 50 mm, no more than 40 mm, no more than 30 mm, no more than 20 mm, no more than 10 mm, nor more than 5 mm, or otherwise. For example, for a foil attachment assembly 110 may include a track having a length of 120 mm, and the installation positions may be separated by increments of 10 mm. In some embodiments, the foil plate 140 may be positioned at any position along the track of the foil attachment assembly 110.

Figure 2A:
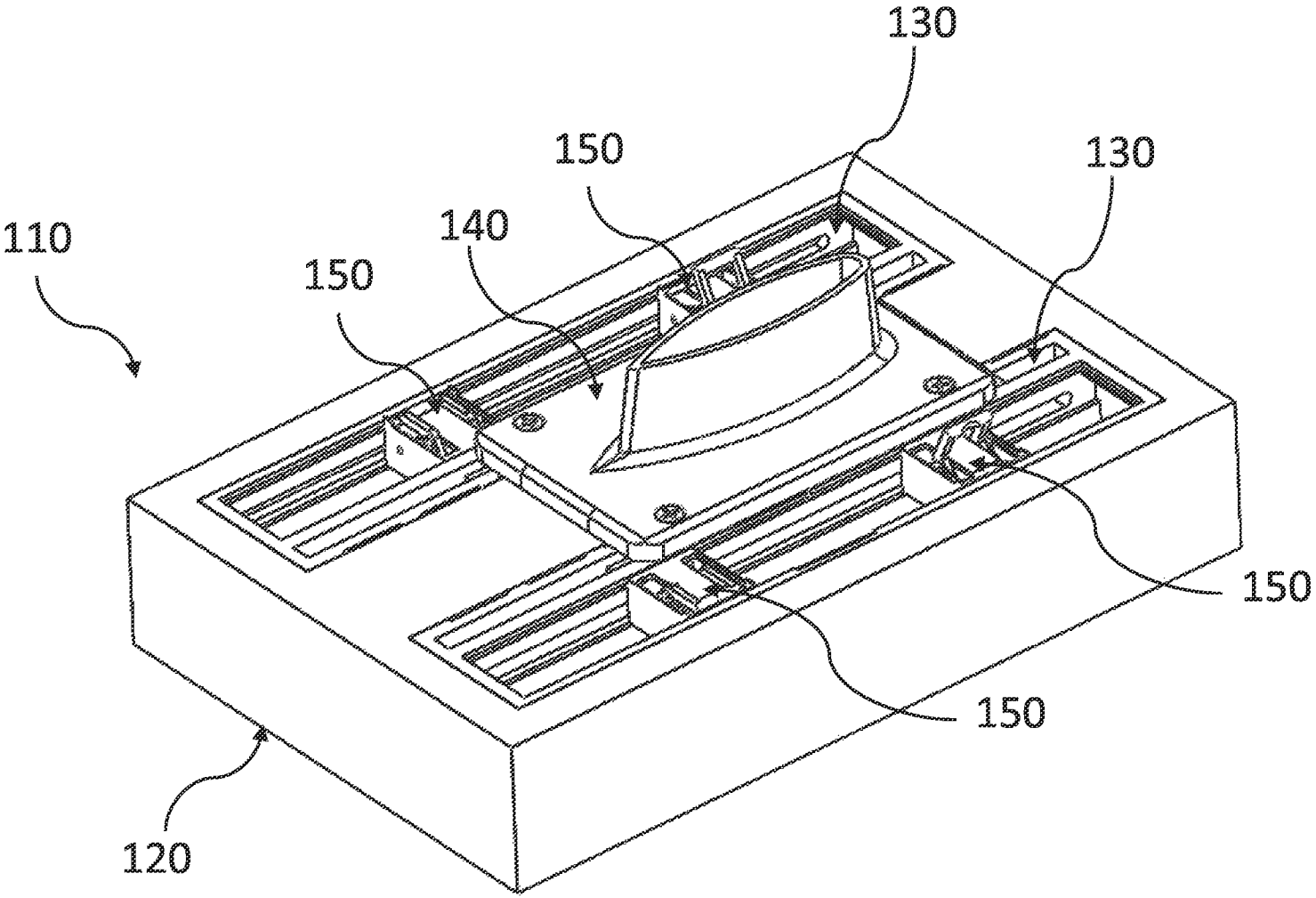
FIGS. 2A-2F illustrate exemplary details of the foil attachment assembly shown in FIG. 1.
Figure 2B:
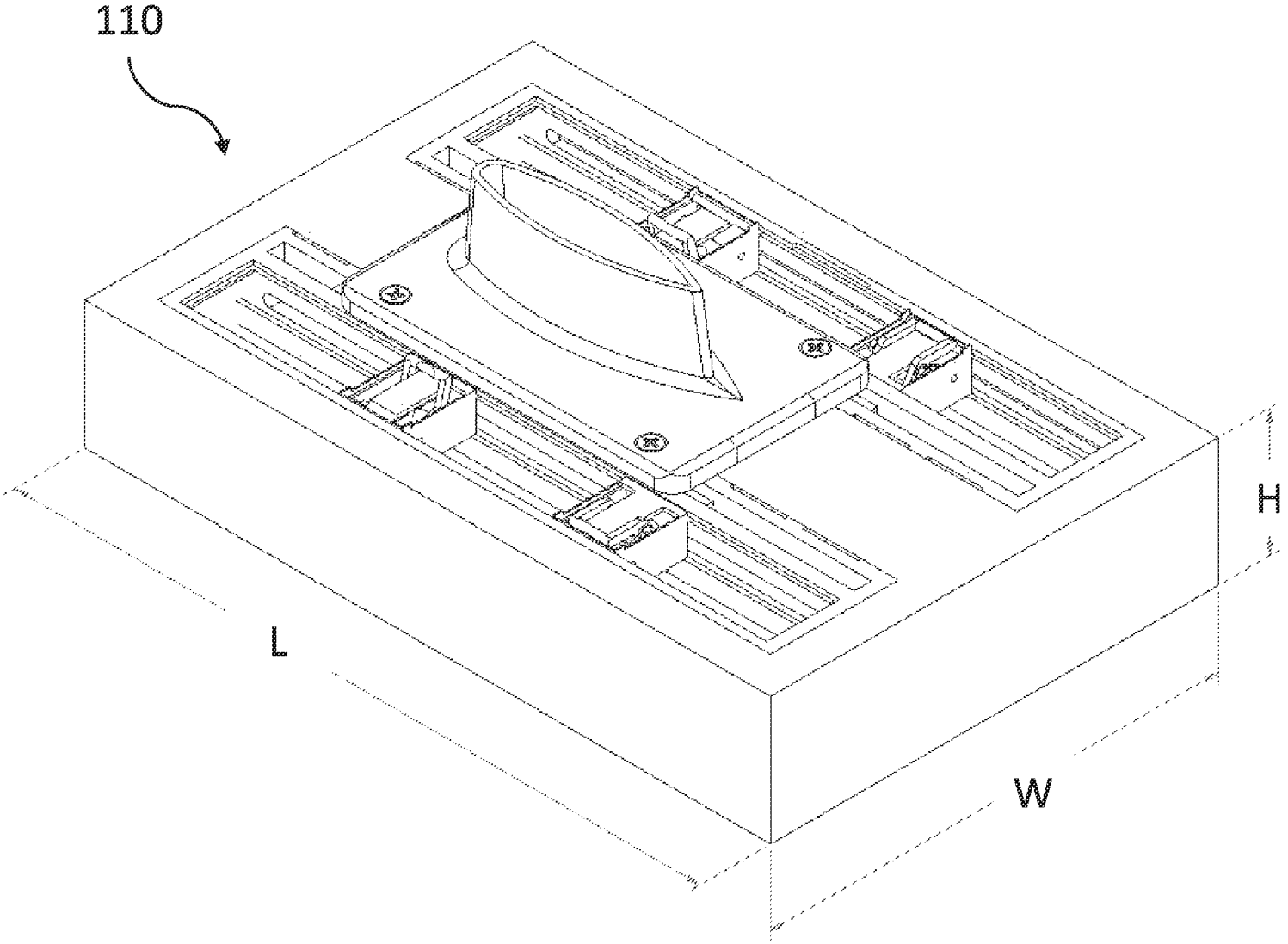
Figure 2C:
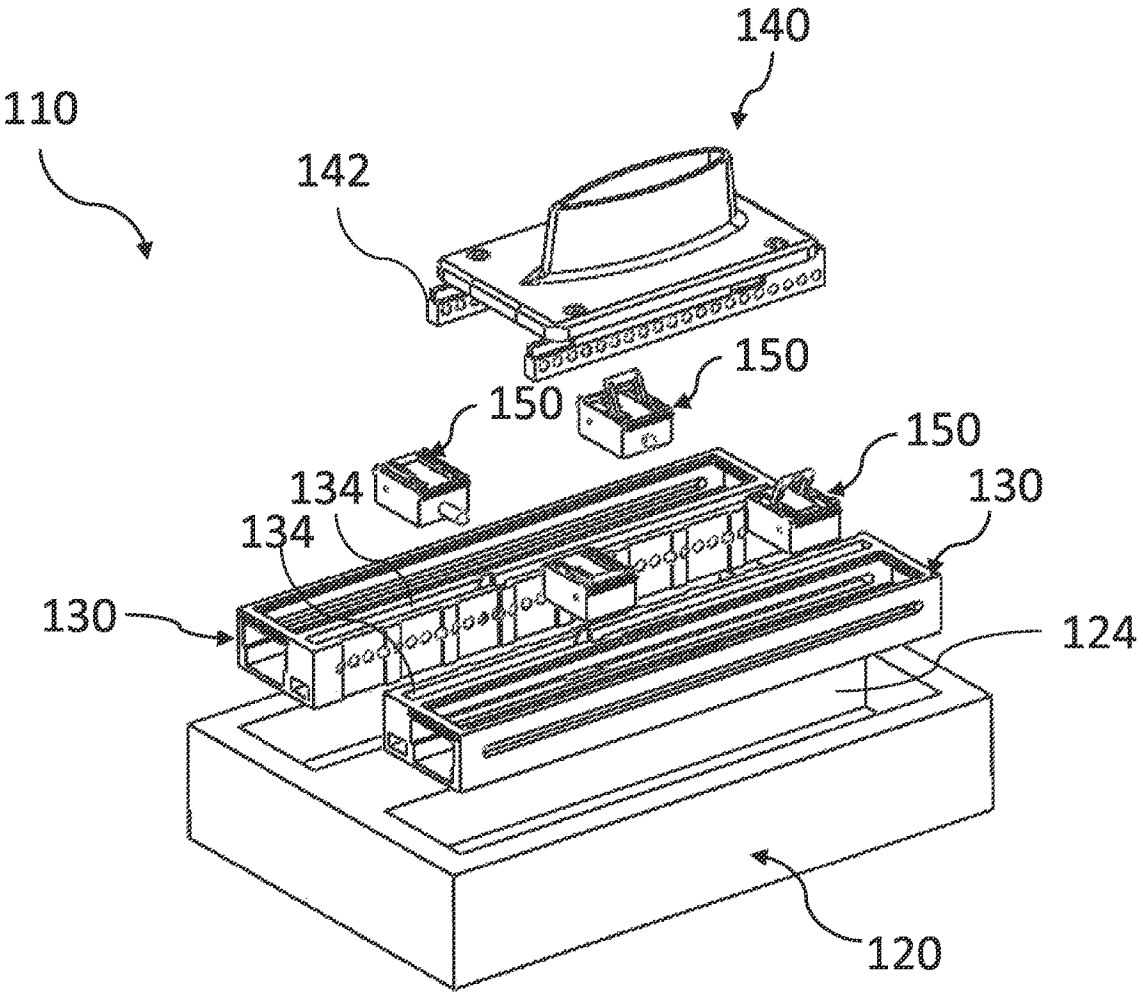
Figure 2D:
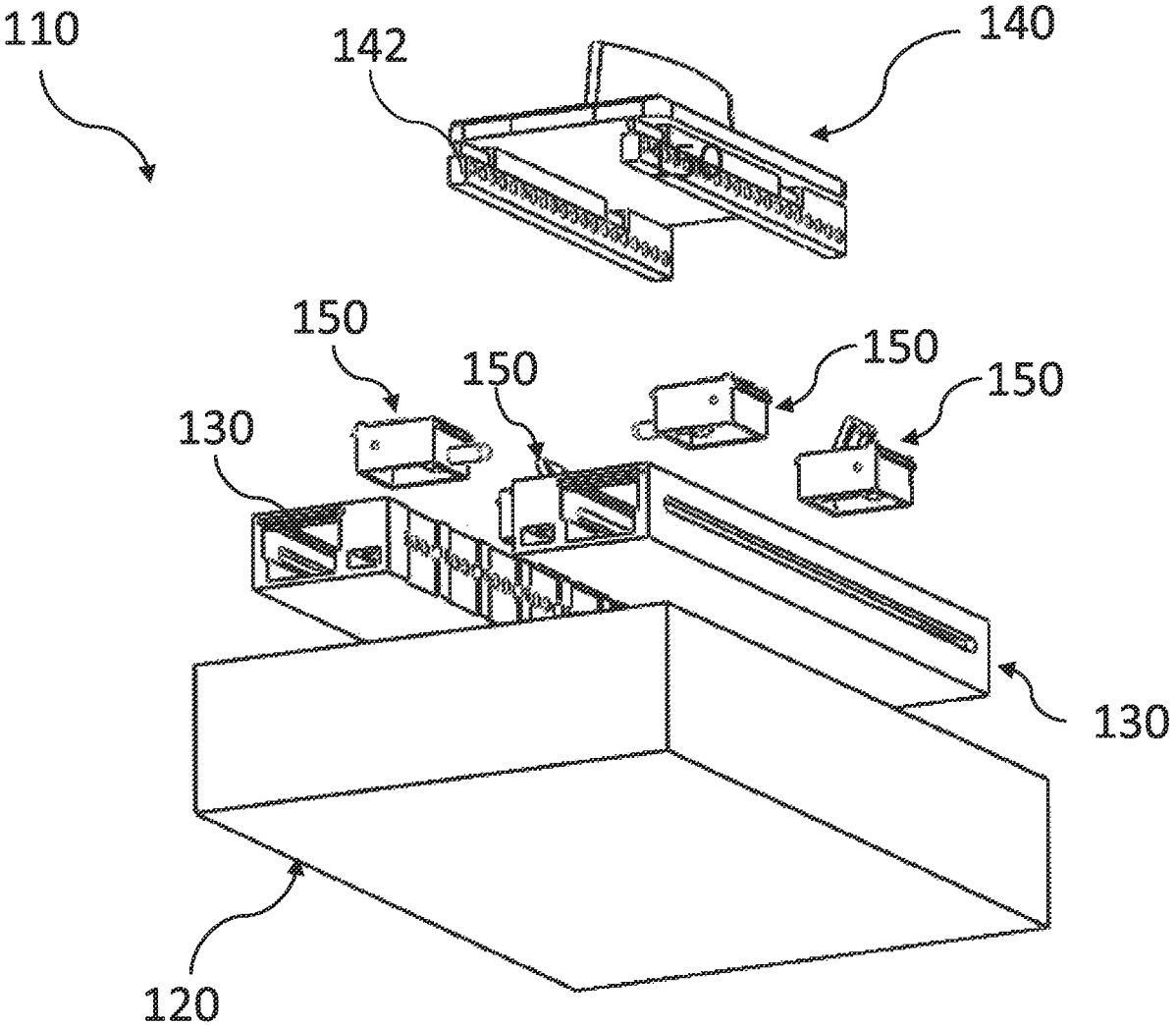
Figure 2F:
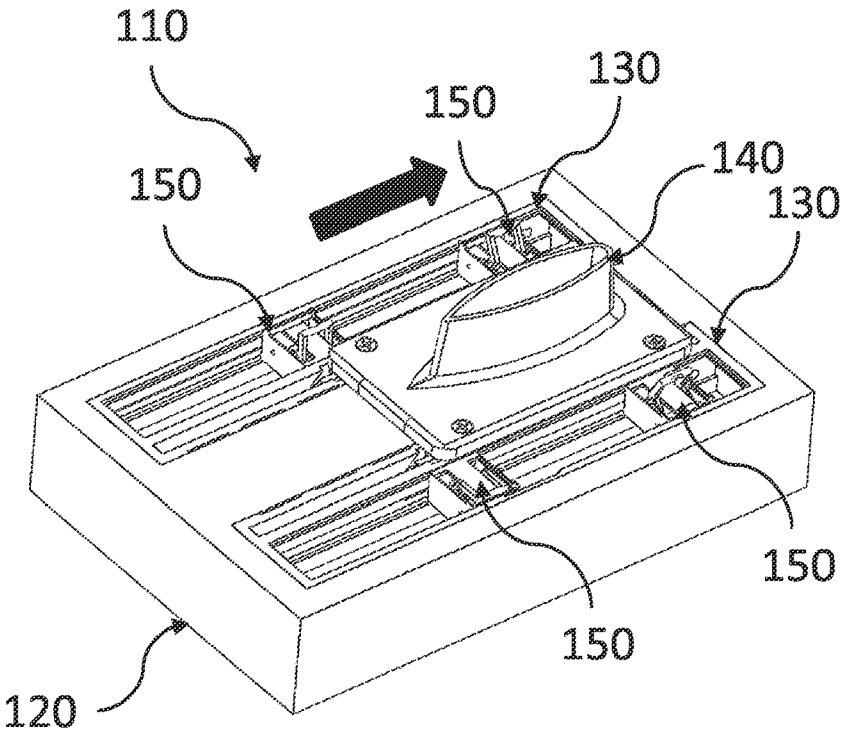
Figure 2E:
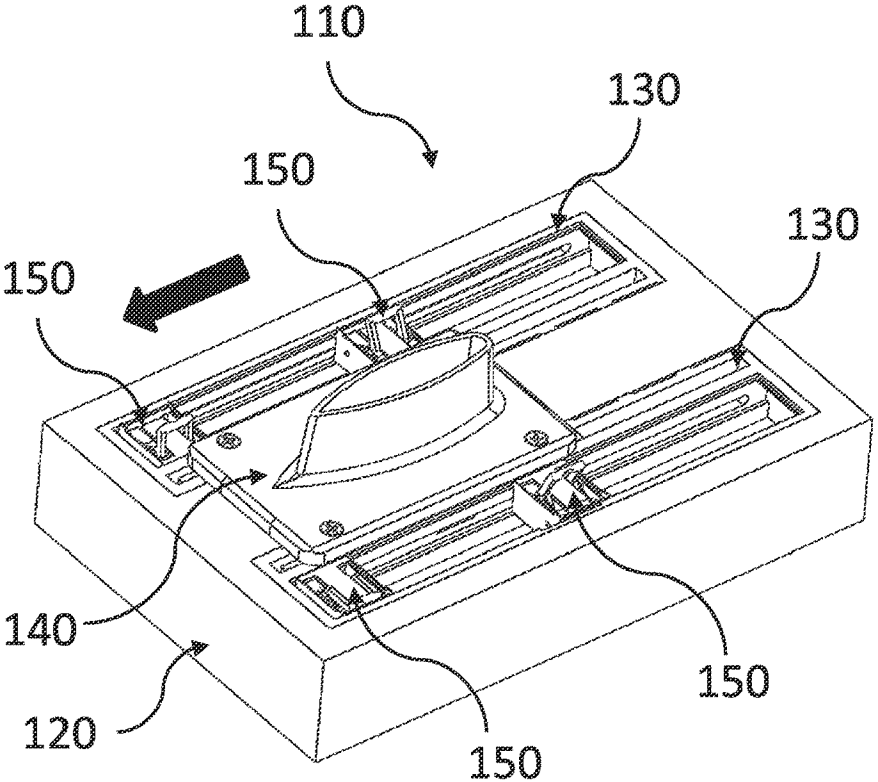

FIGS. 2C-2D illustrate partial exploded views of the foil attachment assembly 110. A foil plate 140 may be removably attached to the adaptor 142. The adaptor 142 may be configured to be at least partially disposed within a cavity or trench 134 in a trench frame 130. Corresponding alignment features in the trench frame 130 and the adaptor 142 may be configured to control a position of the adaptor 142 relative to the trench frame 130. The trench frame 130 may be disposed within recess(es) 124 in a housing 120. In some configurations, the entire trench frame 130 may be disposed within the housing 120.

Hydrofoil manufacturers may advantageously manufacture their foil plates to include a removable or even a nonremovable permanent adaptors. A non-tool adjustment can quickly and straightforwardly move an attached hydrofoil to change the operation of the surfboard 100 by shifting the hydrofoil toward or away from a center of gravity. The non-tool attachment of the adaptor 142 to the trench frame 130 allows a user to quickly and toollessly change from one hydrofoil with an attached adaptor 142 to another hydrofoil with another attached adaptor 142. Thus, a user may have the surfboard with a mounted trench frame 130. The user may purchase one or more adaptors 142 and removably mount them to the plates of their hydrofoils, and then swap those hydrofoils as conditions or desire dictate without a need for specialty tools.

One or more toolless locking assemblies 150 (e.g., at least two, at least four, or otherwise) may be at least partially disposed in the trench frame 130. For example, each locking assembly 150 may be entirely disposed in cavities in the trench frame 130. The foil plate 140 may be secured to the trench frame 130 in at least two positions along a length of the foil attachment assembly, for example on a front side of the foil plate 140 and a rear side of the foil plate 140. Securing the foil plate on the front and rear sides provides enhanced securement. As illustrated, the foil attachment assembly 110 includes four locking assemblies 150. A pair of locking assemblies 150 may be positioned on a front side of the foil plate 140, and a pair of locking assemblies 150 may be positioned at a rear side of the foil plate 140. Each pair of locking assemblies 150 may include a first locking assembly on a right side of the foil plate 140 and a second locking assembly on a left side of the foil plate 140.

With reference to FIG. 2B, the length L of the foil attachment assembly 110 can be greater than a width W and/or a height H of the foil attachment assembly 110. The length L may be at least 1.5× and/or less than or equal to 2.0× of the width W. The height H may be at least about 25% and/or less than or equal to about 50% of the length L. The length L may at least about 300 mm and/or less than or equal to about 400 mm, for example between 300 mm and 350 mm, between 325 mm and 375 mm, or between 350 mm and 400 mm. The width W may be at least about 200 mm and/or less than or equal to about 300 mm, for example between 200 mm and 250 mm, between 225 mm and 275 mm, or between 250 mm and 300 mm. The height H may be less than or equal to about 100 mm, for example between 25 mm and 50 mm, between 50 mm and 75 mm, or between 75 mm and 100 mm.

Figure 3A:
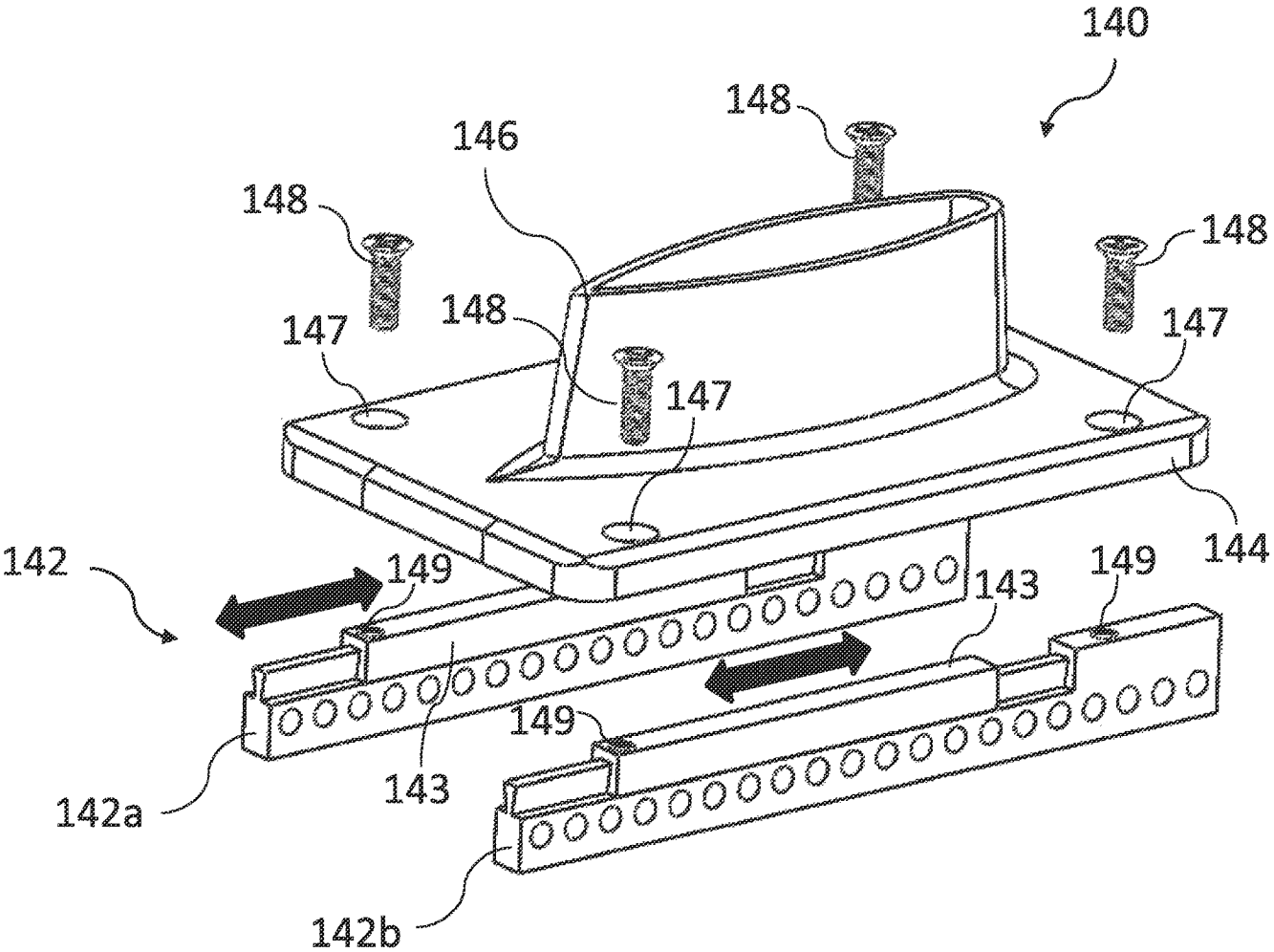
FIGS. 3A-3B illustrates exemplary details of a sub-assembly of the foil attachment assembly including an adaptor.
Figure 3B:
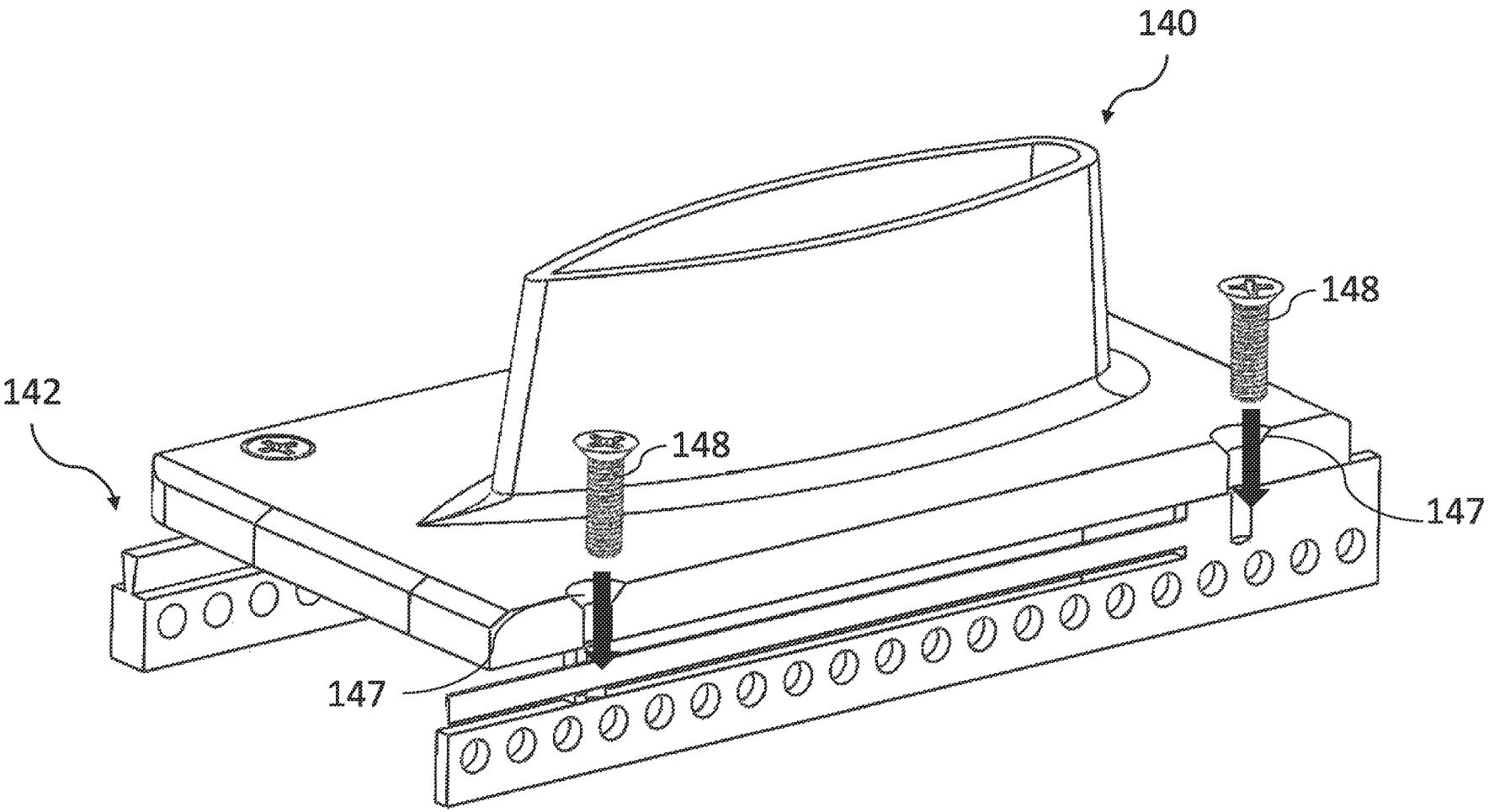

FIGS. 3A-3B illustrate exemplary details of the adaptor 142 and the foil plate 140. The foil plate 140 can include a plate section 144 and a connection portion 146 configured to attach to a mast of a hydrofoil. The connection portion 146 may project from the plate section 144. As illustrated, the connection portion 146 may include a curved profile, for example oval-shaped, to interface with a corresponding attachment feature on a mast. The plate section 144 can be mechanically fastened to the adaptor 142 by one or more locking screws or other fasteners 148, but in other configurations, the plate section 144 can be chemically fastened or integrally connected to the adaptor 142.

Figure 3C:
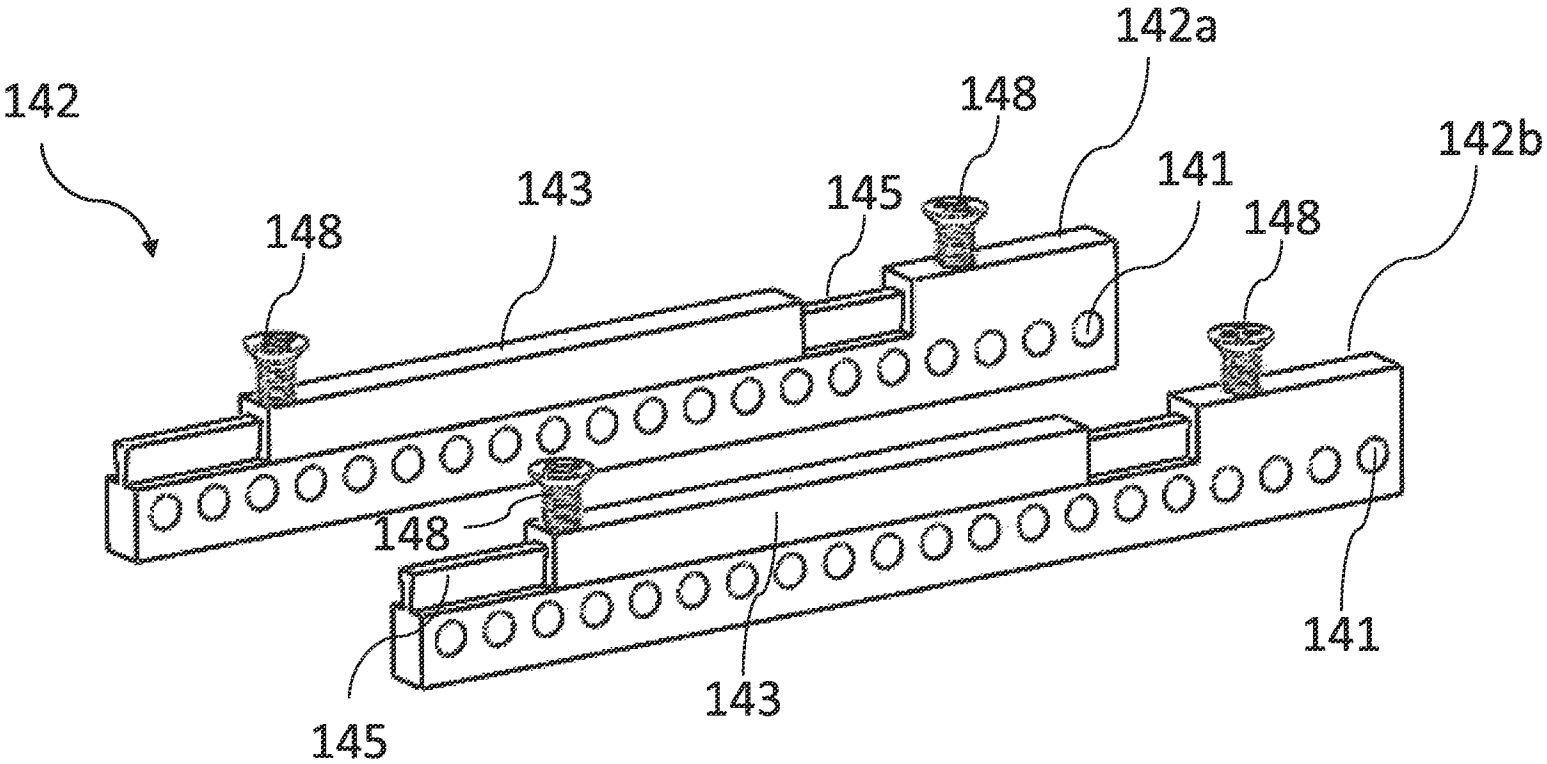
FIG. 3C illustrates exemplary details of the adaptor shown in FIGS. 3A-3B.

As shown in FIG. 3C, the adaptor 142 may include parallel rail sections 142*a*, 142*b* configured to interface with parallel trench portions in the trench frame 130. As illustrated, the rail sections 142*a*, 142*b* may be separate components. The rail sections 142*a*, 142*b* may be distinct components connected to each other only through the foil plate 140 or the trench frame 130. But in other configurations, the rail sections 142*a*, 142*b* may be connected by a transverse component at either end of the adaptor 142 or therebetween. Each rail section 142*a*, 142 can include a plurality of apertures 141 along its length. The plurality of apertures 141 may be arranged in an array and positioned below the guide structure 145. The apertures 141 may extend transversely through lateral walls of the rail sections 142*a*, 142*b*. When engaged, a component of the locking assemblies 150 can extend through one of the apertures 141 to secure the adaptor 142 to the trench frame 130. With the plurality of apertures 141, the adaptor 142 may be secured at a plurality of positions along a length of the trench frame 130, for example at least three positions, at least four positions, at least five positions, at least six positions, at least seven positions, at least eight positions, or at least ten positions.

A length of each rail section 142*a*, 142*b* may be adjusted to accommodate different sized plate sections foil plates 140. Each rail section 142*a*, 142*b* can include an adjustable portion 143 configured to slide lengthwise relative to a remainder of the rail section 142*a*, 142*b*. The adjustable portion 143 may slide along a guide structure 145 on the rail section 142*a*, 142*b*. For example, the length of the rail section 142*a*, 142*b* may be adjusted using a dovetail slider.

As shown in FIGS. 3A-3B, the plate section 144 of the foil plate 140 and/or the rail sections 142*a*, 142*b* may include fastening portions, for example including mounting holes 147 or mounting holes 149, respectively. For example, the plate section 144 may include a plurality of plate mounting holes 147, and the adaptor 142 may include the same number of rail mounting holes 149. The rail mounting holes 149 may extend through at least a partial thickness of the rail sections 142*a*, 142*b*, for example between upper and lower edges of the rail sections 142*a*, 142*b*. Two of the rail mounting holes 149 may be disposed on the adjustable portion 143 of the rail sections 142*a*, 142*b*. In use, the adjustable portions 143 of the rail sections 142*a*, 142*b* may slide back and forth until the four rail mounting holes 149 align with the four plate mounting holes 147. In other configurations, the adaptor 142 may include a greater number of mounting holes 149 than the plate section 144 to accommodate different sized plate sections 144.

Figure 4:
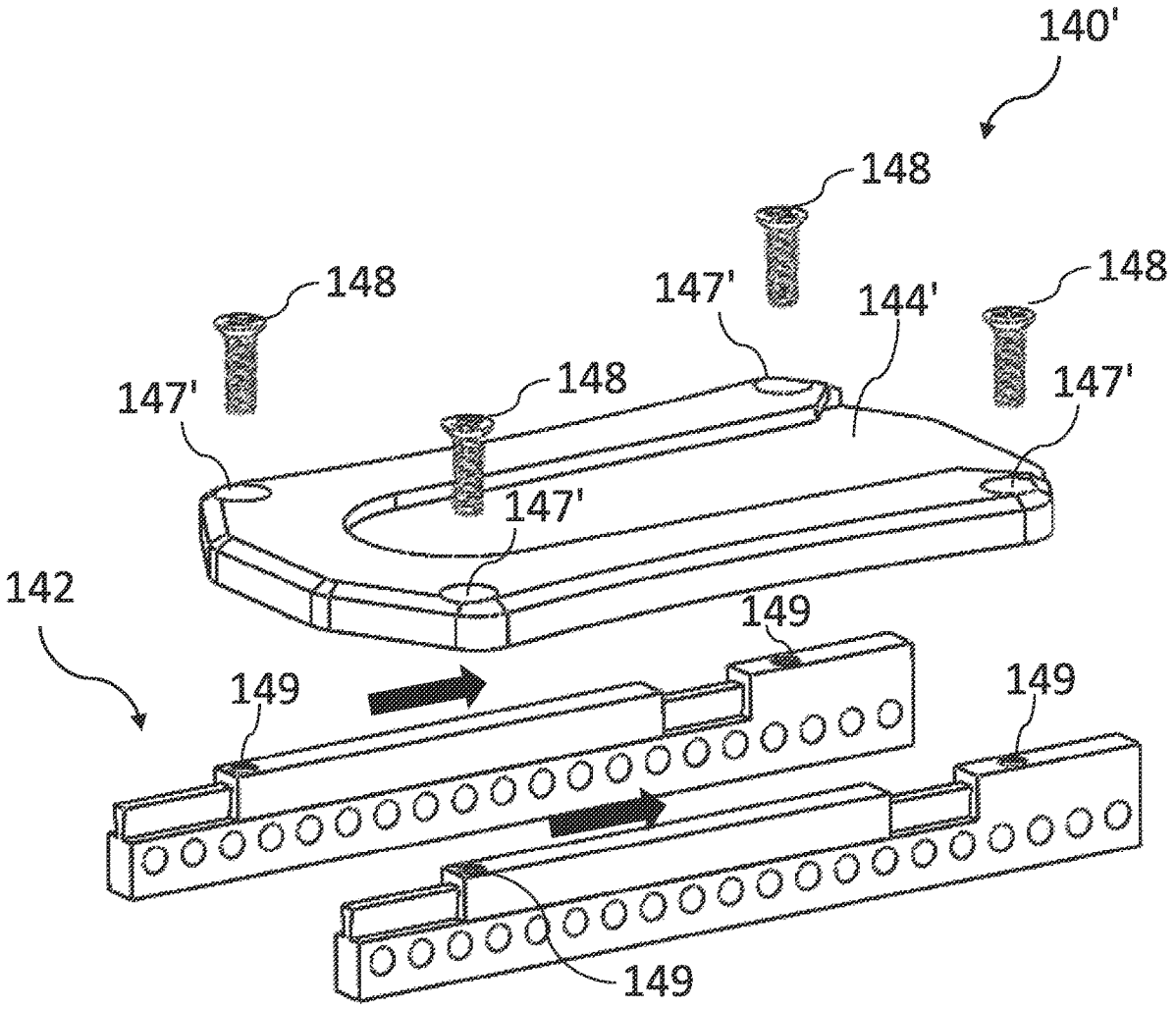
FIGS. 4 and 5 illustrate the adaptor shown in FIG. 3C in combination with alternative foil plates.
Figure 5:
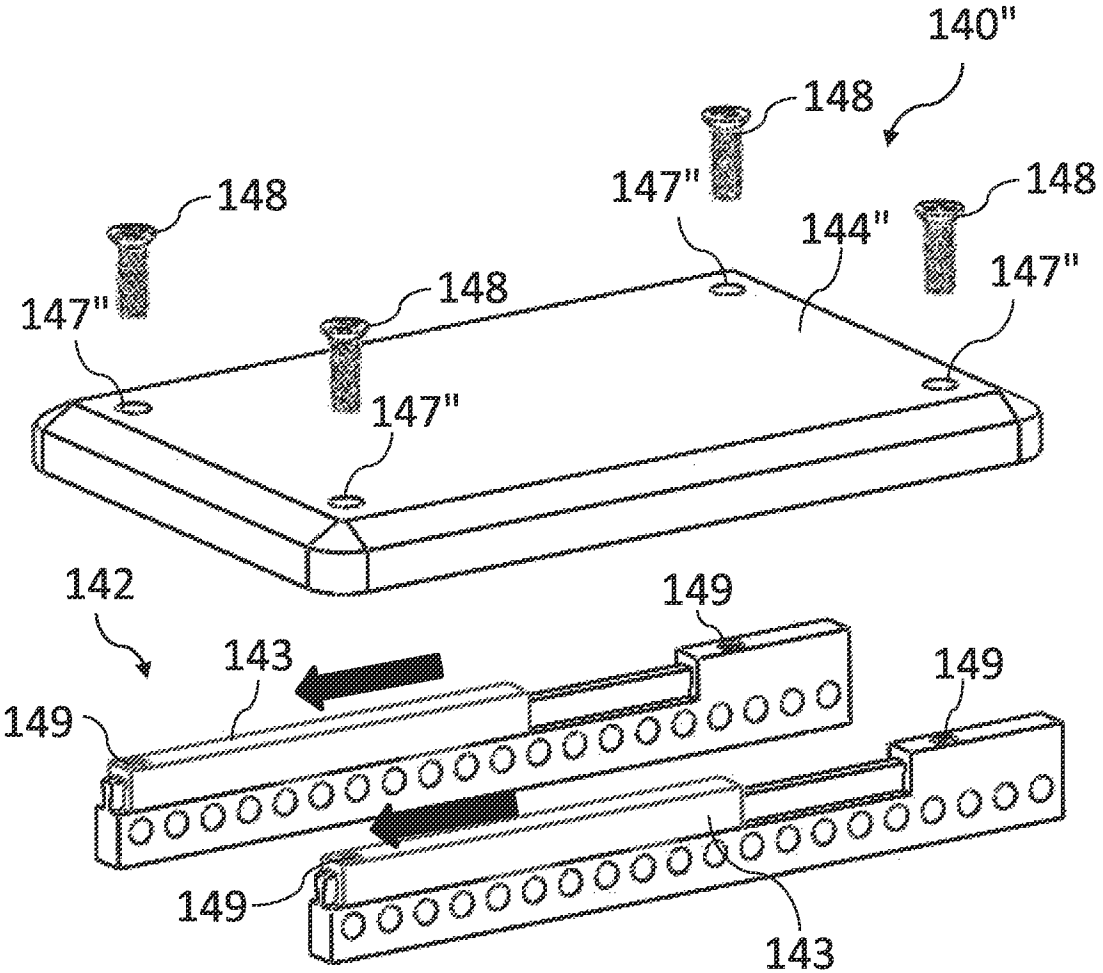

As shown in FIGS. 4 and 5, the adjustable portion 143 may slide along the guide structure 145 to fit a longer foil plate 140" (FIG. 5) or to fit a shorter foil plate 140' (FIG. 4). The same adaptor 142 can be used to accommodate the foil plates 140', 140". In FIG. 4, the adjustable portions 143 can be moved inward to accommodate the mounting holes 147' in the plate section 144'. In FIG. 5, the adjustable portions 143 can be moved outward to accommodate the mounting holes 147" in the plate section 144". In some embodiments, the adaptor 142 is fixed and does not adjust, but has multiple fastener portions to accommodate different sized foil plates 140.

Figure 6:
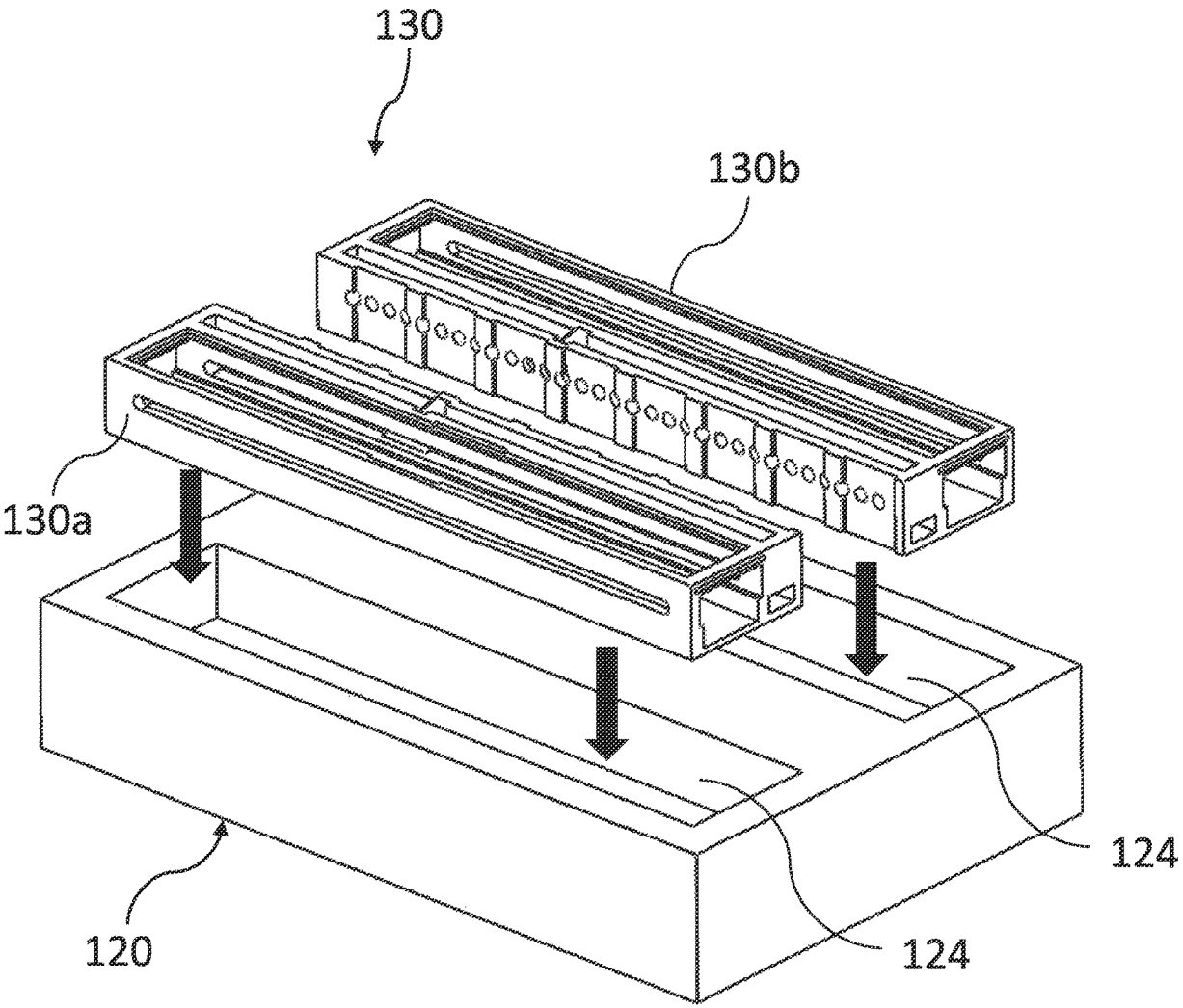
FIG. 6 illustrates exemplary details of a sub-assembly of the foil attachment assembly including a trench frame.

FIG. 6 illustrate a sub-assembly with the housing 120 and the trench frame 130. The housing 120 may include one or more recesses 124 shaped and sized to receive a corresponding portion 130*a*, 130*b* of the trench frame 130. The frame portions 130*a*, 130*b* may be made of a thermoplastic material such as acrylonitrile butadiene styrene. The recess(es) 124 may be formed in the bottom surface of the housing 120. The trench frame 130 may be adhered or otherwise fixed to the housing 120. When assembled, the entire trench frame 130 may be disposed within the housing 120. A bottom surface of the trench frame 130 may be flush with or recessed from a bottom surface of the housing 120. The housing 120 may be glassed in with the surfboard 100. A portion of the trench frame 130 may also be glassed in, but the trench 134 remains open to receive the adaptor 142.

The housing 120 may include the same material as the surfboard 100. For example, the housing material may include a foam material, such as high-density polyvinyl chloride foam. As illustrated, the housing 120 may be box-shaped or have a rectangular profile. However, the housing 120 may take on any other shape such as a circular or triangular profile. As explained above, at least a partial or full thickness of the housing 120 may be received within the surfboard 100.

Figure 7:
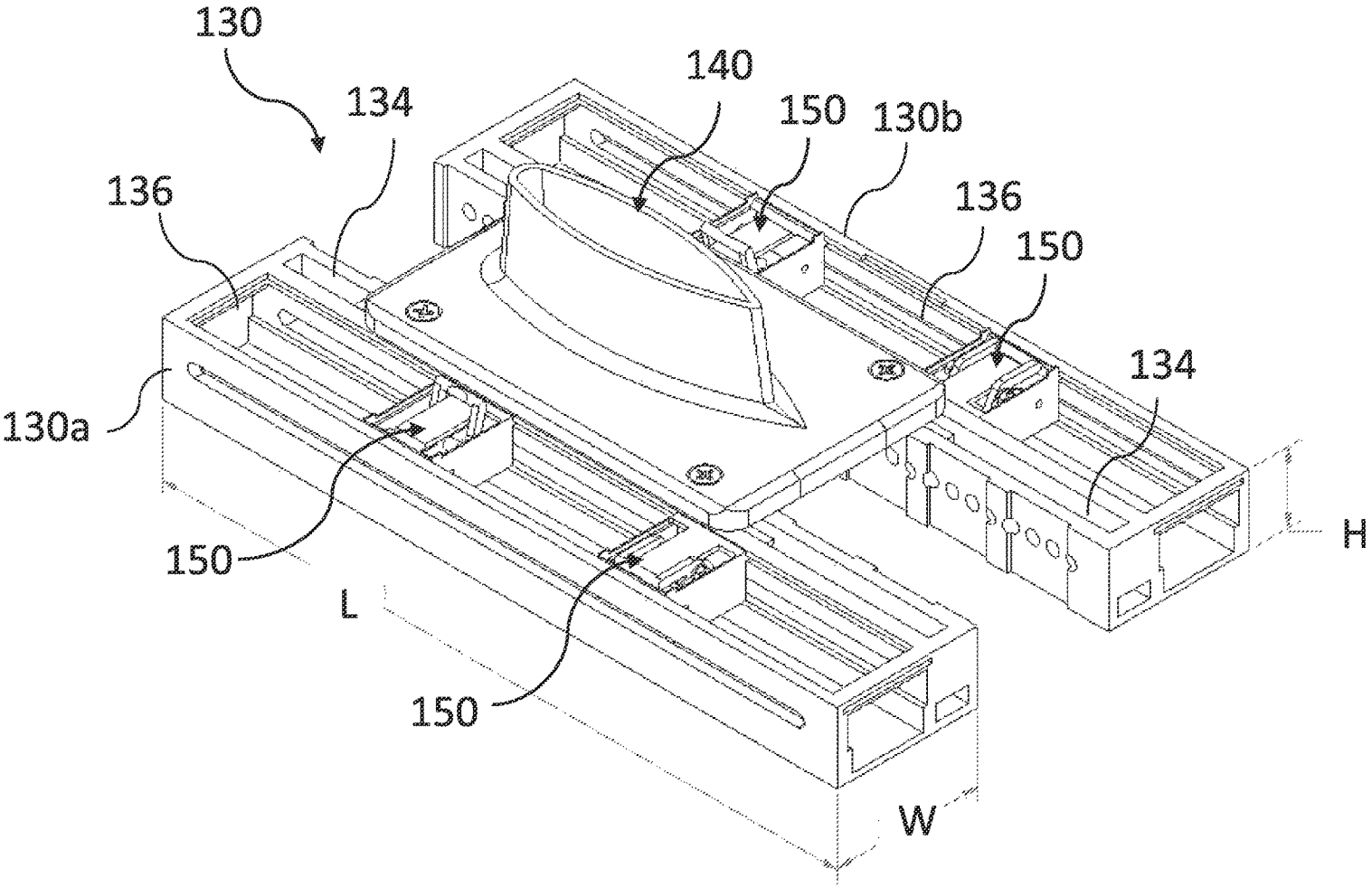
FIG. 7 illustrates exemplary details of the foil attachment assembly shown in 2A-2F without the enclosure.

As shown in FIG. 7, the trench frame 130 may include parallel frame portions 130*a*, 130*b*. Each frame portion 130*a*, 130*b* has a trench 134 extending longitudinally in a front to rear direction. The trenches 134 are configured to receive corresponding rail sections 142*a*, 142*b* of the adaptor 142. The adaptor 142 is designed to slide vertical into trenches 134, and then slide horizontally to adjust a position of the adaptor 142 (shown in FIGS. 2E and 2F).

Each frame portion 130*a*, 130*b* may include a recessed portion 136. The recessed portions 136 may extend longitudinally in a front to rear direction. Each recessed portion 136 may be parallel with the corresponding trench 134 in the same frame portion 130*a*, 130*b*. The recessed portions 136 may extend along the same length as the trench 134. Each recessed portion 136 may be wider than the trench 134.

Each recessed portion 136 may be configured to receive one or more locking assemblies 150. The one or more locking assemblies 150 may be built into the trench frame 130 or separate components positioned within the trench frame 130. The recessed portions 136 may be sized to receive the one or more locking assemblies 150 from the bottom surface of the trench frame 130.

Figure 8A:
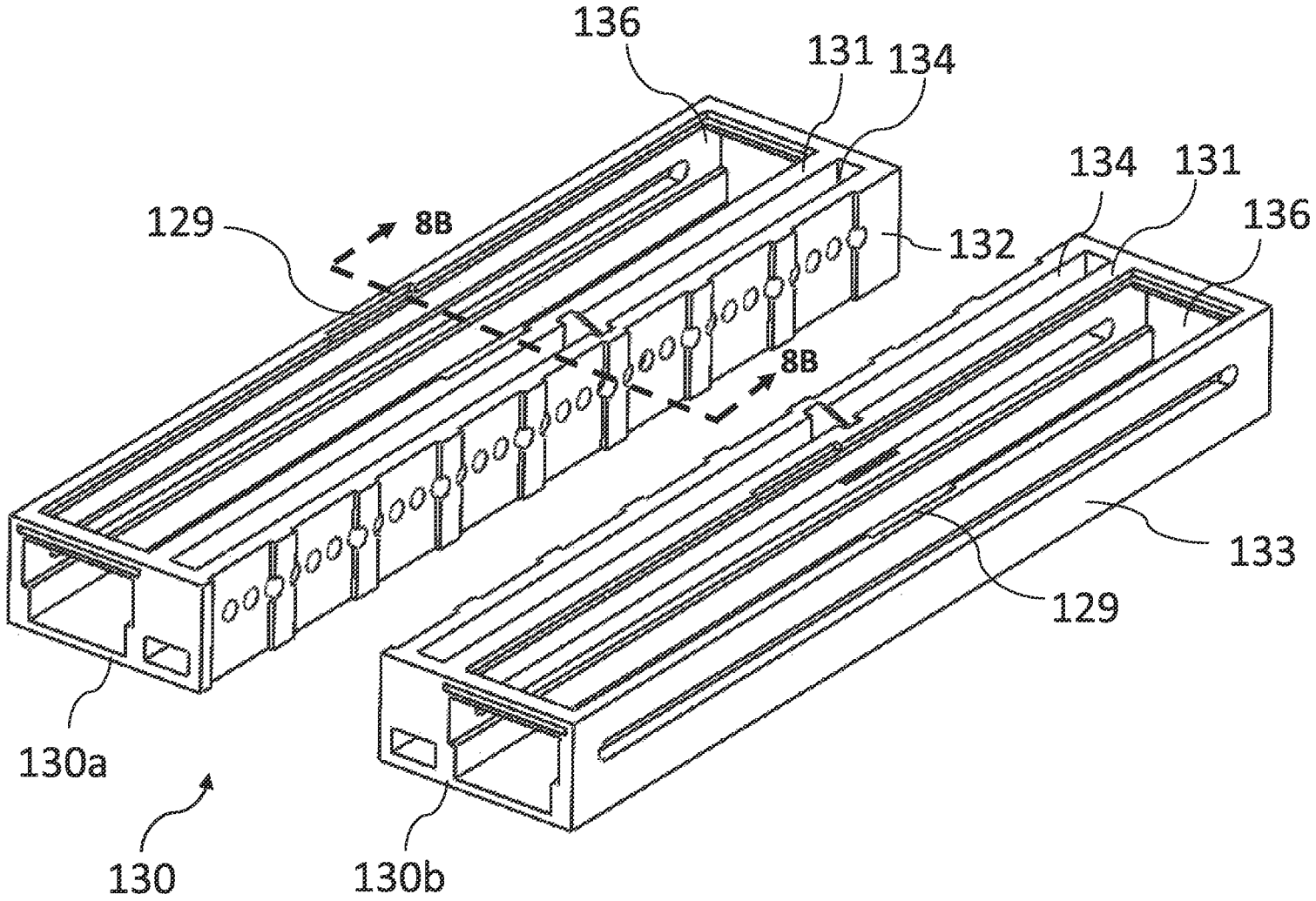
FIGS. 8A-8B illustrate exemplary details of the trench frame shown in FIG. 6.

As shown in FIG. 8A, the frame portions 130*a*, 130*b* may be separate components without any connecting transverse components therebetween. The rail sections 142*a*, 142*b* may be independently disposed within the housing 120 and only be connected to each other through the housing 120 or the foil plate 140. But in other configurations, the frame portions 130*a*, 130*b* may be connected by a transverse component at either end of the trench frame 130 or therebetween.

An artisan will recognize from the disclosure herein that use of the parallel frame portions 130*a*, 130*b* increases or even maximizes the amount of connection surface area within a limited box depth, thereby advantageously increasing or maximizing an amount of multi-directional stresses and torsion the combined assembly can withstand. The box depth limits are a function of the dimensions of the surfboard 100, which are often chosen for desired performance and rider weight characteristics and not simply for box accommodations.

Each frame portion 130*a*, 130*b* can include a first outer wall 133 and a second outer wall 132. The first outer wall 133 can be an exterior facing wall, and the second outer wall 132 can be an interior facing wall. The second outer wall 132 can face the other frame portion. As depicted in FIG. 8*a*, at least the second outer wall 132 has an uneven surface. The second outer wall 132 can include surface features to improve attachment to the housing 120. As illustrated, the second outer wall 132 includes a plurality of projections extending along a thickness dimension of the frame portions 130*a*, 130*b* with indentations therebetween. The surface modifications can improve the attachment with the housing 120, for example by providing increased surface area for an adhesive. The surface modifications may be present on any one of walls on the frame portions 130*a*, 130*b*. The surface modifications may be shaped or sized differently, for example extending in a lengthwise direction. The recessed portion 136 and the trench 134 can be separated by an interior wall 131. The recessed portion 136 can be defined between the first outer wall 133 and the interior wall 131. The trench 134 can be defined between the interior wall 131 and the second outer wall 132. The frame portions 130*a*, 130*b* can include one or more cutouts to reduce the total weight of the attachment assembly. For example, as shown in FIG. 8*a*, there is a lengthwise cutout in the first outer wall 133 of frame portion 130*b*. A similar cutout may be present on frame portion 130*a*. The end walls between the first and second outer walls 133, 132 can also have cutouts. For example, as shown in FIG. 8, the end wall can include two openings providing access to the trench 134 and recessed portion 136.

Each recessed portion 136 can include an enlarged portion 129 to facilitate insertion of the locking assembly 150. The enlarged portion 129 can include a larger width than adjacent portions of the recessed portion 136. The recessed portion 136 can include an open slot in the first outer wall 133 and/or the interior wall 131 to accommodate the locking assembly 150.

Figure 8B:
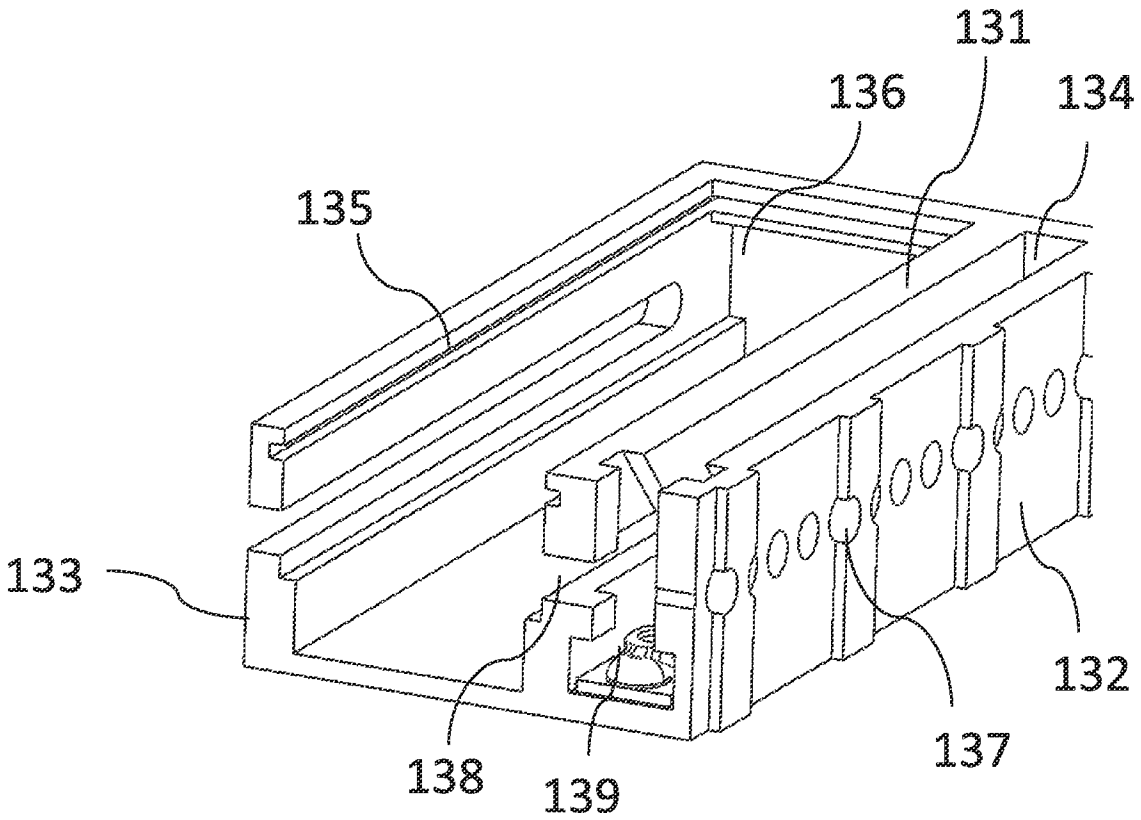

As shown in FIG. 8B, the trench frame portions 130*a*, 130*b* can include one or more mounting features 139 to mount a traditional foil plate. For example, the mounting features 139 can be disposed within the trenches 134. This enables the attachment assemblies to be used with traditional foil plates that do not have the adaptor 142 described herein.

Each frame portion 130*a*, 130*b* can include a passageway 138 in the interior wall 131 to receive a component of the locking assembly 150. As illustrated, the passageway 138 is an elongate slot extending along a length of the interior wall 131 to accommodate the locking assembly 150 at different positions. But in other configurations, the passageway 138 can be an array of openings similar to holes 137. Each frame portion 130*a*, 130*b* can include one or more holes 137 in the second outer wall 132 of the frame portion 130*a*, 130*b*. Each hole 137 can accommodate a component of the locking assembly 150 at different positions along the trench frame 130. The passageway 138 and holes 137 enable the locking assembly 150 to lock the adaptor 142 to the trench frame 130. The passageway 138 permits a component of the locking assembly 150 to extend into the trench 134. A component of the locking assembly 150 may extend through the passageway 138 in the interior wall 131 of the trench frame 130, through an opening in the adaptor 142, and at least partially into one of the holes 137 in the second outer wall 132 of the trench frame 130. The one or more holes 137 can be arranged in an array along a length of the second outer wall 132 to accommodate the locking assembly 150 at different positions.

Each frame portion 130*a*, 130*b* can include one or more slots 135 to capture the one or more locking assemblies 150. For example, each frame portion 130*a*, 130*b* can include a slot 135 on either side of the recessed portion 136. The slot(s) 135 can extend along a length of the recessed portion 136. The slot(s) 135 can be recessed from the bottom surface of the trench frame 130 in use. Each locking assembly 150 can include one or more flanges 153 configured to be captured by a corresponding slot 135 in the trench frame 130 (see FIGS. 12A and 12B). For example, each locking assembly 150 can include two flanges 153 on opposite sides of the locking assembly 150. The two flanges 153 can be captured by corresponding slots 135 on opposite sides of the recessed portion 136.

Figure 9:
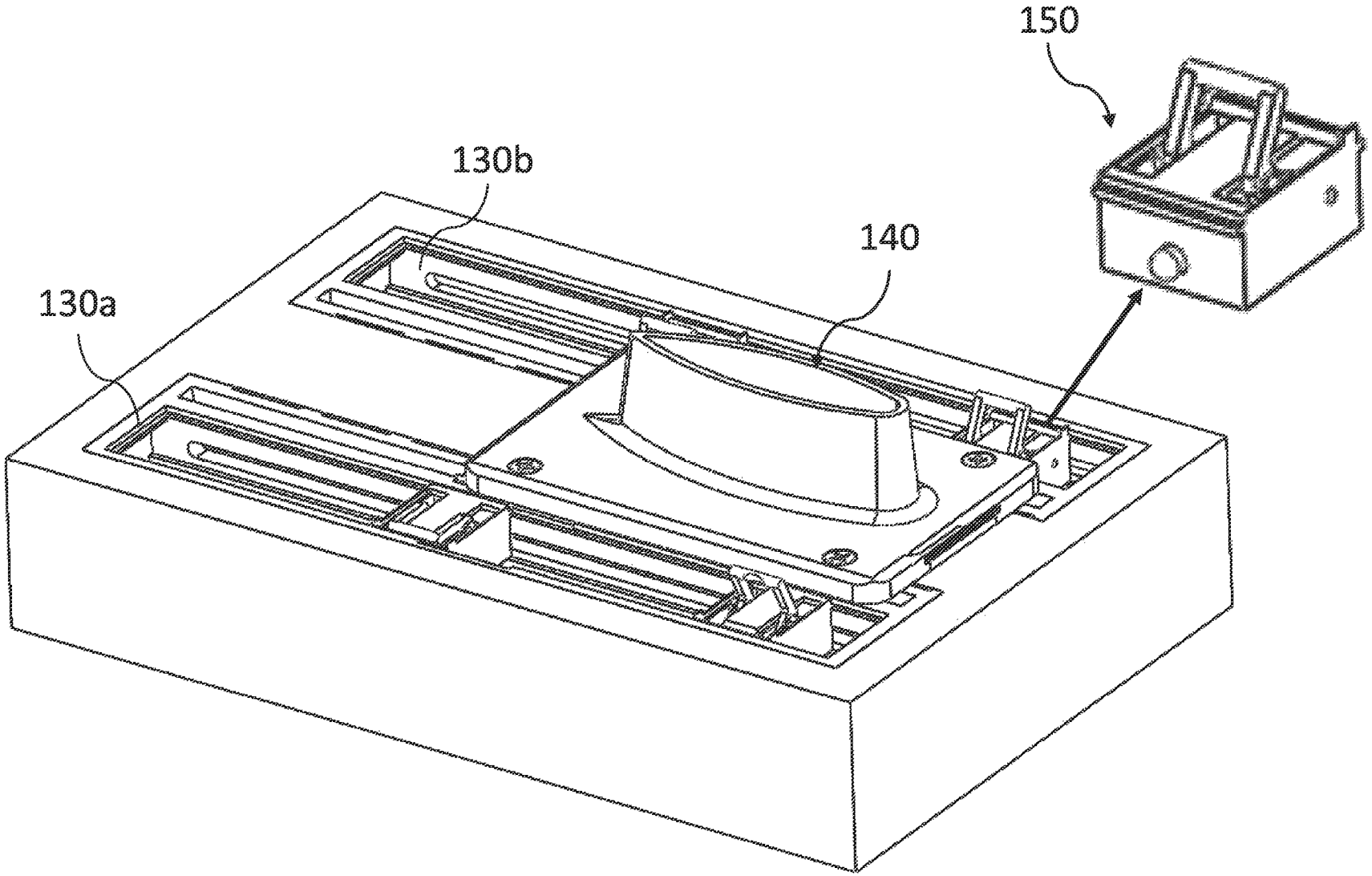
FIG. 9 illustrates exemplary details of the foil attachment assembly with an enlarged view of a locking assembly.

FIG. 9 illustrates exemplary placement of the locking assembly 150 and enlarged view of a locking assembly 150. A single locking assembly 150 can be positioned entirely within a single trench frame portion 130*a*, 130*b*. Each locking assembly 150 can secure a single side or rail section 142*a*, 142*b* of the adaptor 142. When assembled, each locking assembly 150 can be positioned laterally outward of the foil plate 140, for example laterally between the foil plate 140 and the housing 120. As illustrated, two locking assemblies 150 can be used to secure each side or rail section 142*a*, 142*b* of the adaptor 142, but a fewer or greater number of locking assemblies 150 can be used to secure each side or rail section 142*a*, 142*b* of the adaptor 142.

Figure 10A:
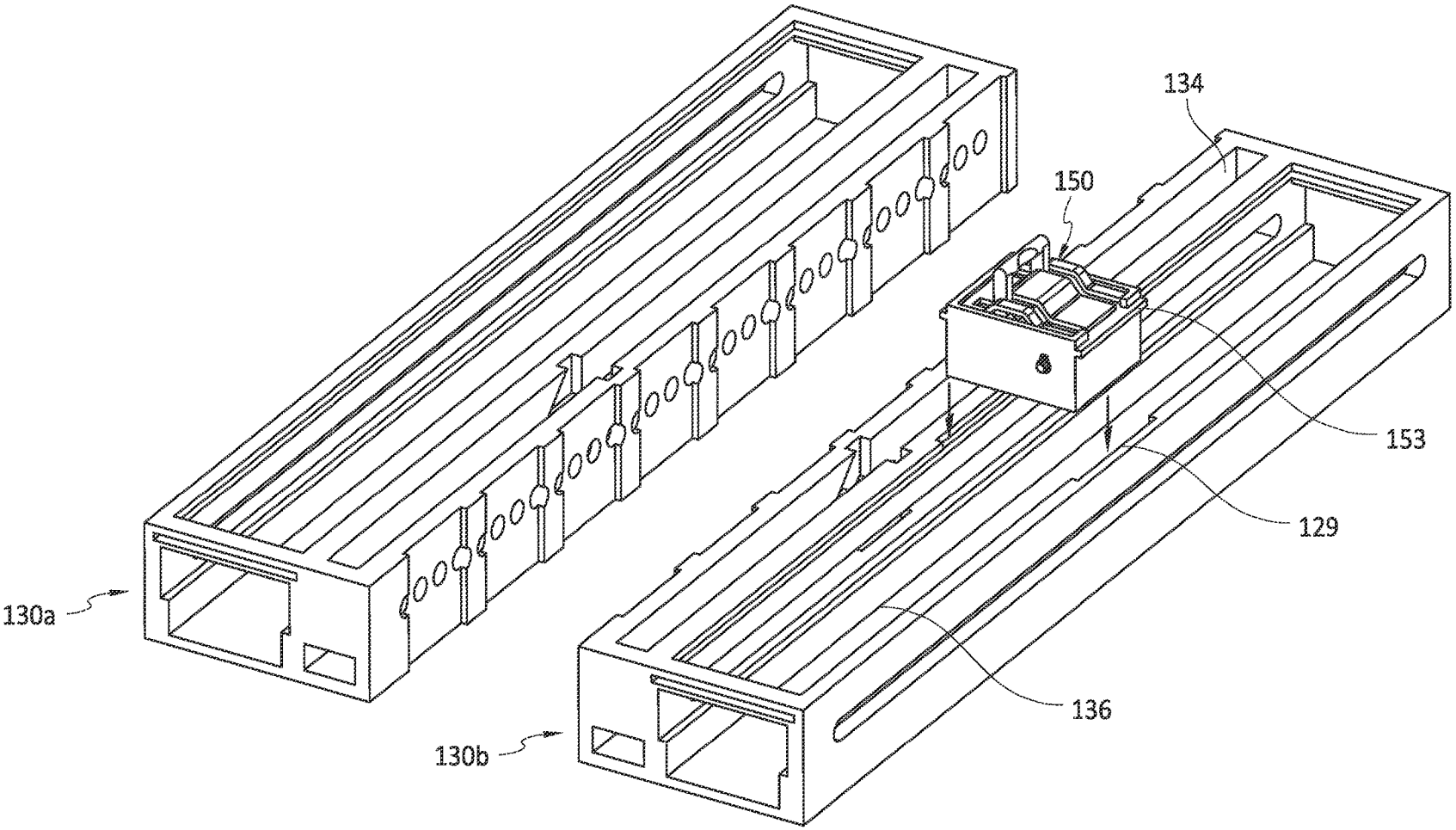
FIGS. 10A-10C illustrate exemplary details of the interaction between the locking assembly and the trench frame.
Figure 10B:
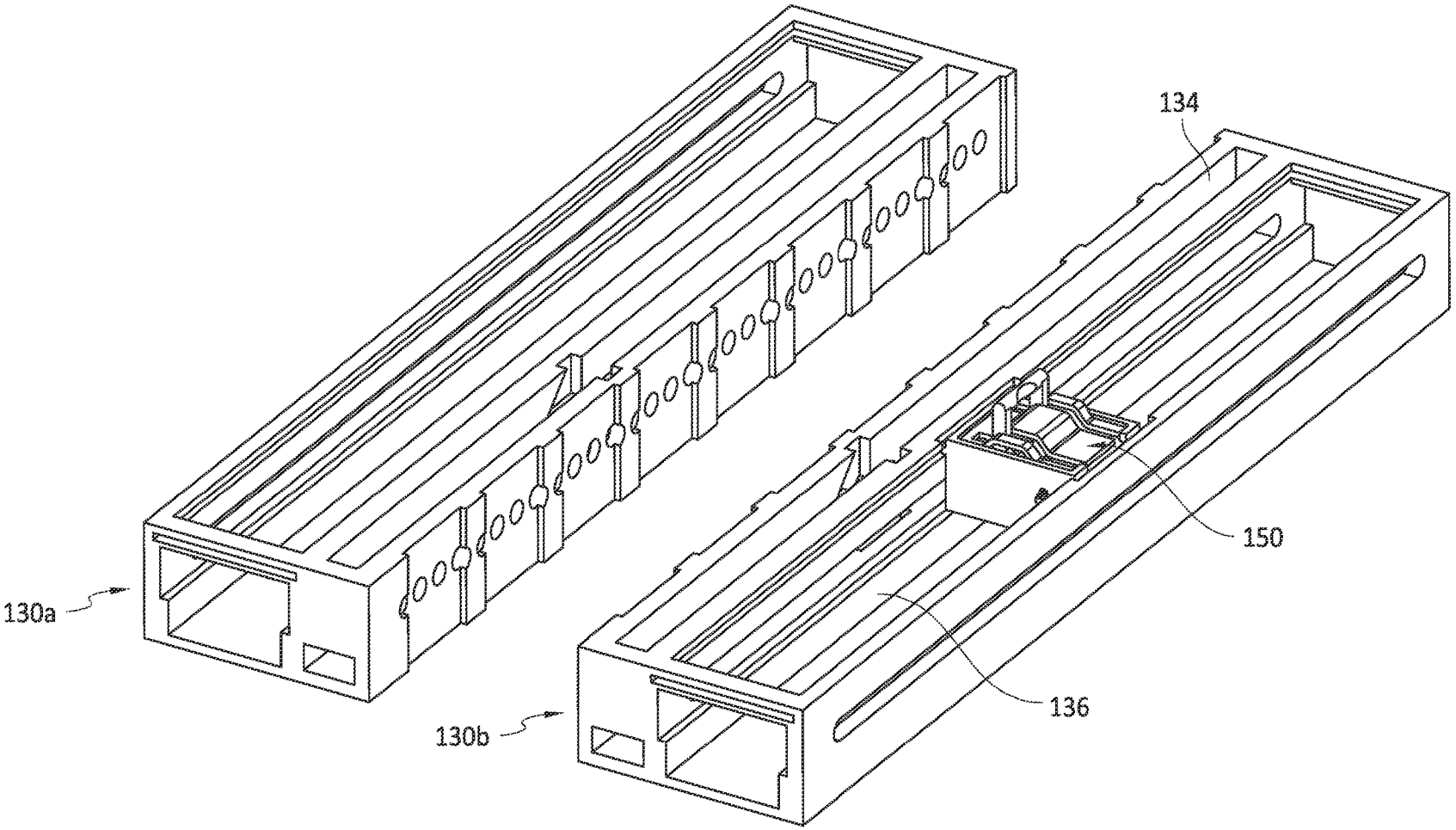
Figure 10C:
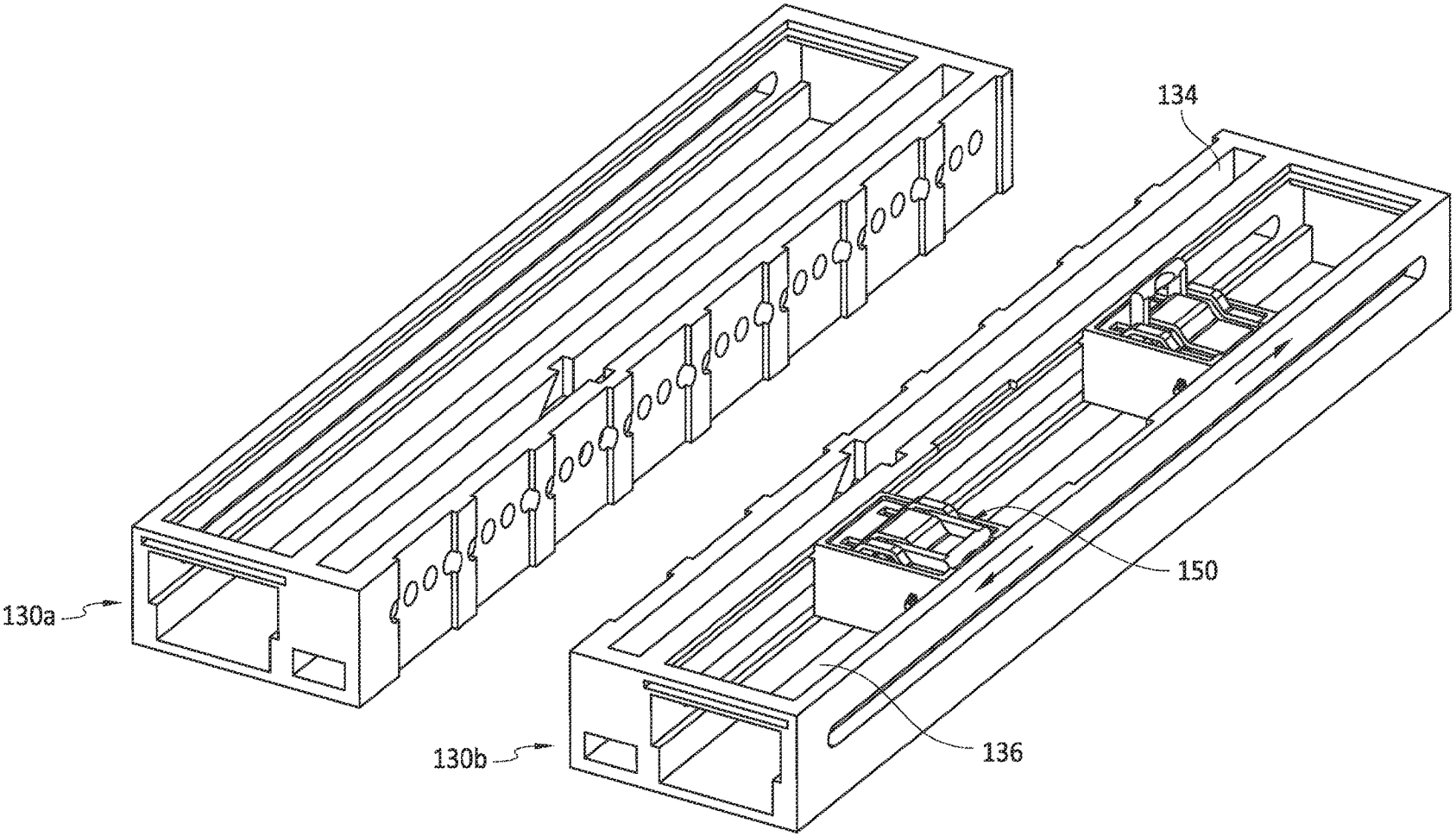

As shown in FIG. 10A, the locking assembly 150 may be introduced at the enlarged portion 129 of the recessed portion 136. Once the locking assembly 150 has been introduced into the recessed portion 136 (see FIG. 10B), the locking assembly 150 can slide along the recessed portion 136 in the front to rear direction (see FIG. 10C). The locking assembly flange(s) 153 can slide within corresponding slot (s) 135 disposed in the recessed portion 136. The slot(s) 135 prevent the locking assembly 150 from inadvertently falling out of the trench frame 130.

FIGS. 11A-11G illustrates exemplary details of a toolless locking assembly 150. The locking assembly 150 is configured to prevent disengagement of the foil plate 140 without the use of any tools. The locking assembly 150 can include a frame 155 configured to support one or more pistons 151 and one or more actuators 157. As illustrated, each locking assembly 150 includes a single piston 151 and a single actuator 157. The piston 151 can have a cylindrical form, but the piston 151 may take on any shape that projects from the frame 155. One or more components of the toolless locking assembly 150 can be made of metal.

The frame 155 is sized to fit entirely within a recessed portion 136 of one of the trench frame portions 130*a*, 130*b*. As annotated in FIG. 11C, the frame 155 may include a length L that is greater or equal to the width W. The length L can be less than or equal to about 50 mm, less than or equal to about 40 mm, or less than or equal to about 30 mm. The width L can be less than or equal to about 50 mm, less than or equal to about 40 mm, or less than or equal to about 30 mm. The width W can be greater than or equal to the height H. The height can be less than or equal to about 50 mm, less than or equal to about 40 mm, or less than or equal to about 30 mm.

Figure 11B:
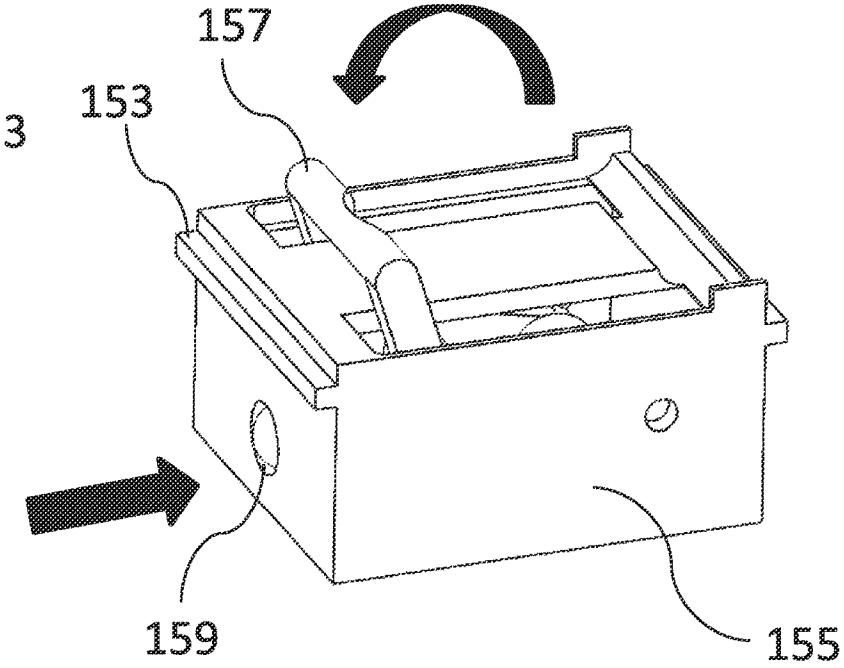
FIGS. 11A-11G illustrate exemplary details of the locking assembly shown in FIG. 9.
Figure 11A:
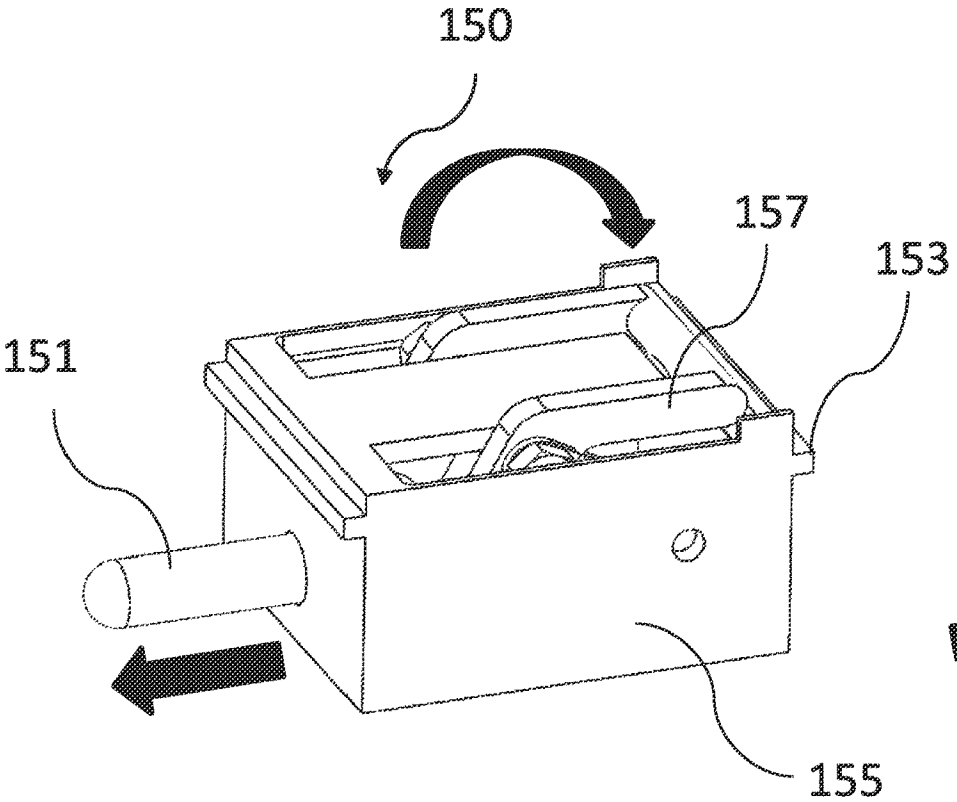
Figure 11C:
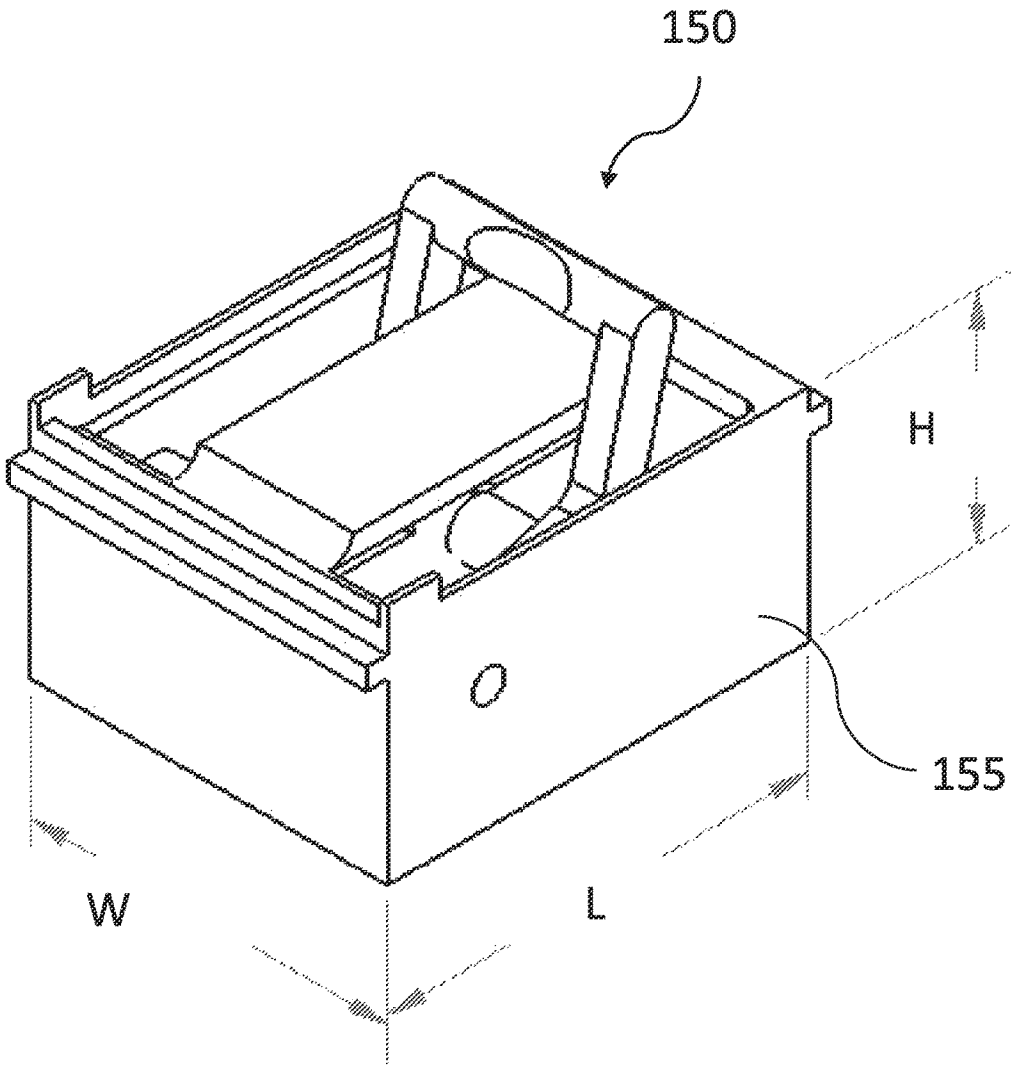
Figure 11E:
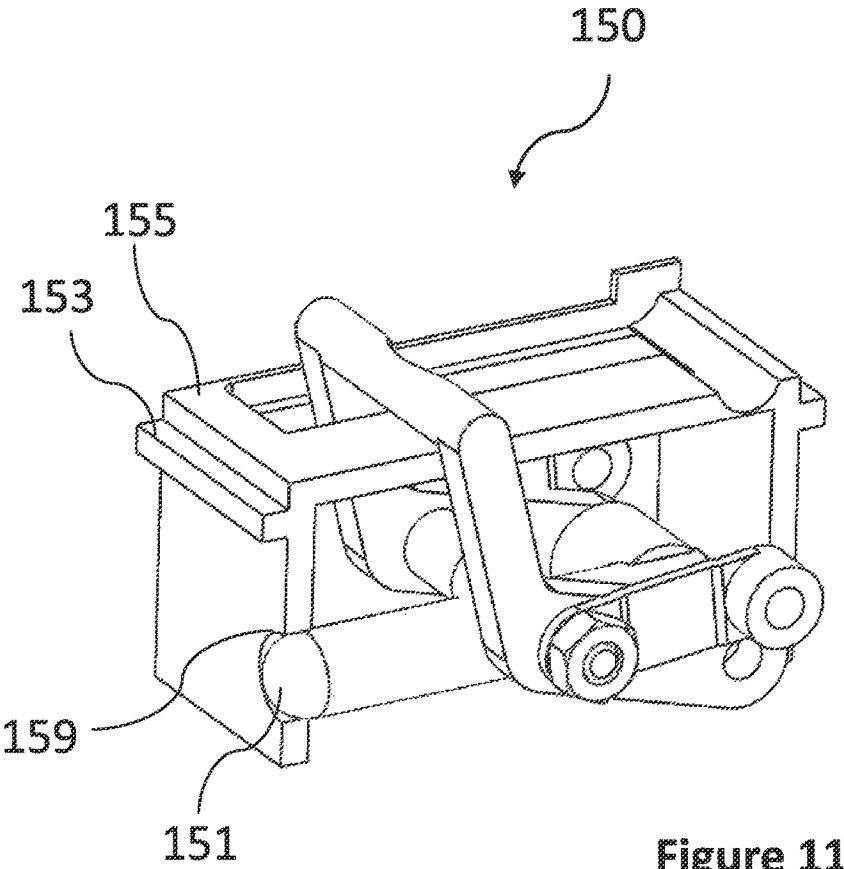
Figure 11D:
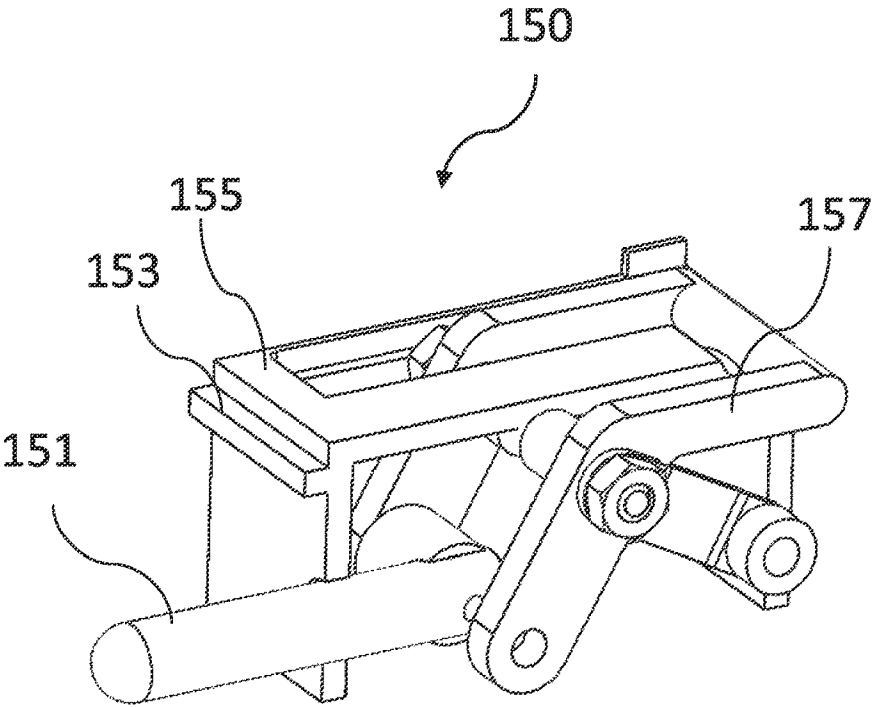
Figure 11G:
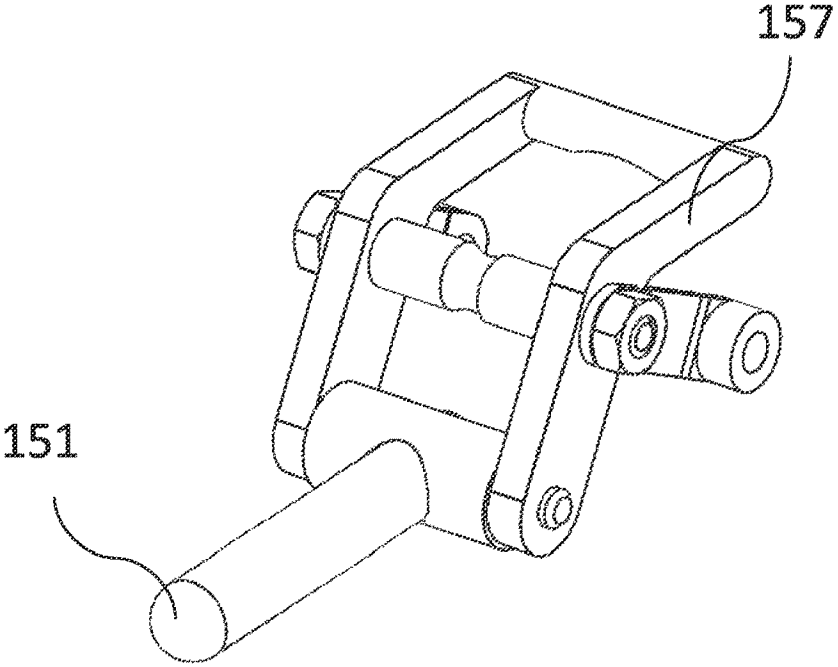
Figure 11F:
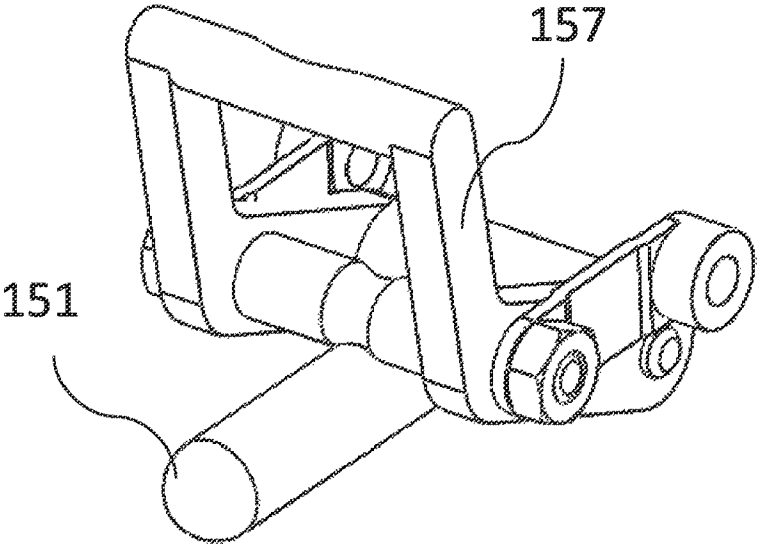

As shown in FIGS. 11D and 11E, the frame 155 can include an interior space configured to receive at least a portion of the actuator 157. As illustrated, the actuator 157 is a lever. The lever can be rotated in a direction toward or away from the foil plate 140. But the actuator 157 may take on other configurations such as buttons or switches. The actuator 157 may be directly or indirectly connected to the piston 151. For example, the actuator 157 may be connected to the piston 151 by one or more linkages or a spring actuated mechanism. FIG. 11D illustrates the locking assembly 150 in a locked configuration with the actuator 157 in a first position and the piston 151 projecting through an opening 159 in the frame 155. FIG. 11E illustrates the locking assembly 150 in a released configuration with the actuator 157 in a second position and the piston 151 in a recessed position relative to the opening 159 in the frame 155. The piston 151 can be advanced or retracted based on corresponding movement of the actuator 157.

Figure 12B:
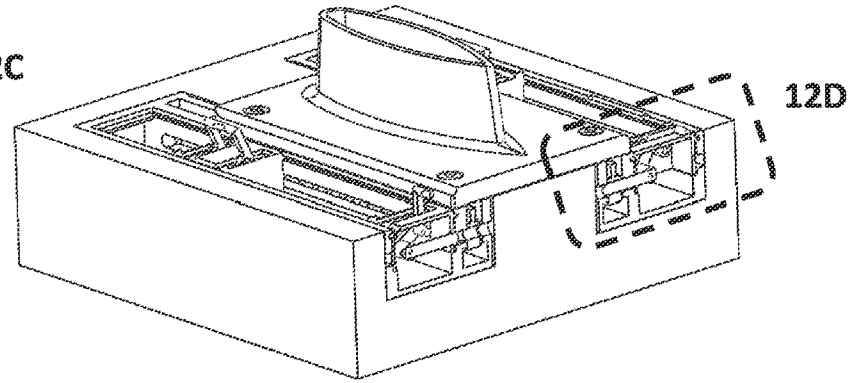
FIGS. 12A-12D illustrate cross-sections showing interaction between the locking assemblies and the foil attachment assembly.
Figure 12A:
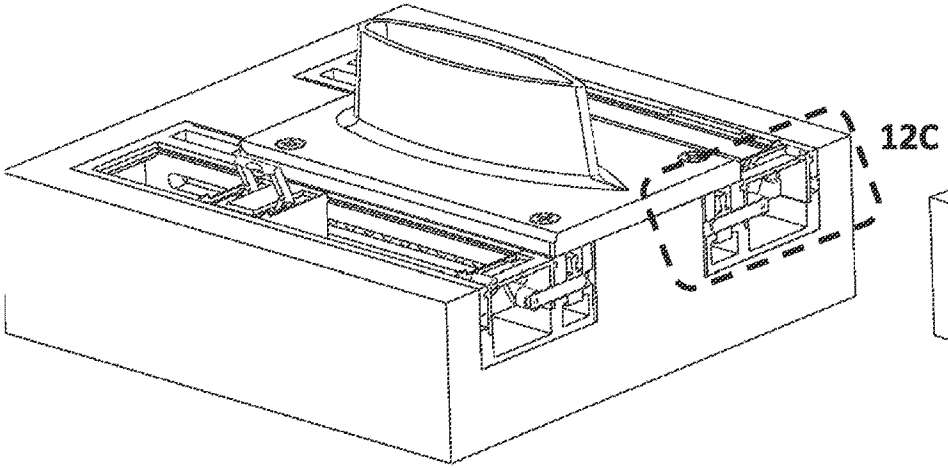
Figures 12C, 12D:
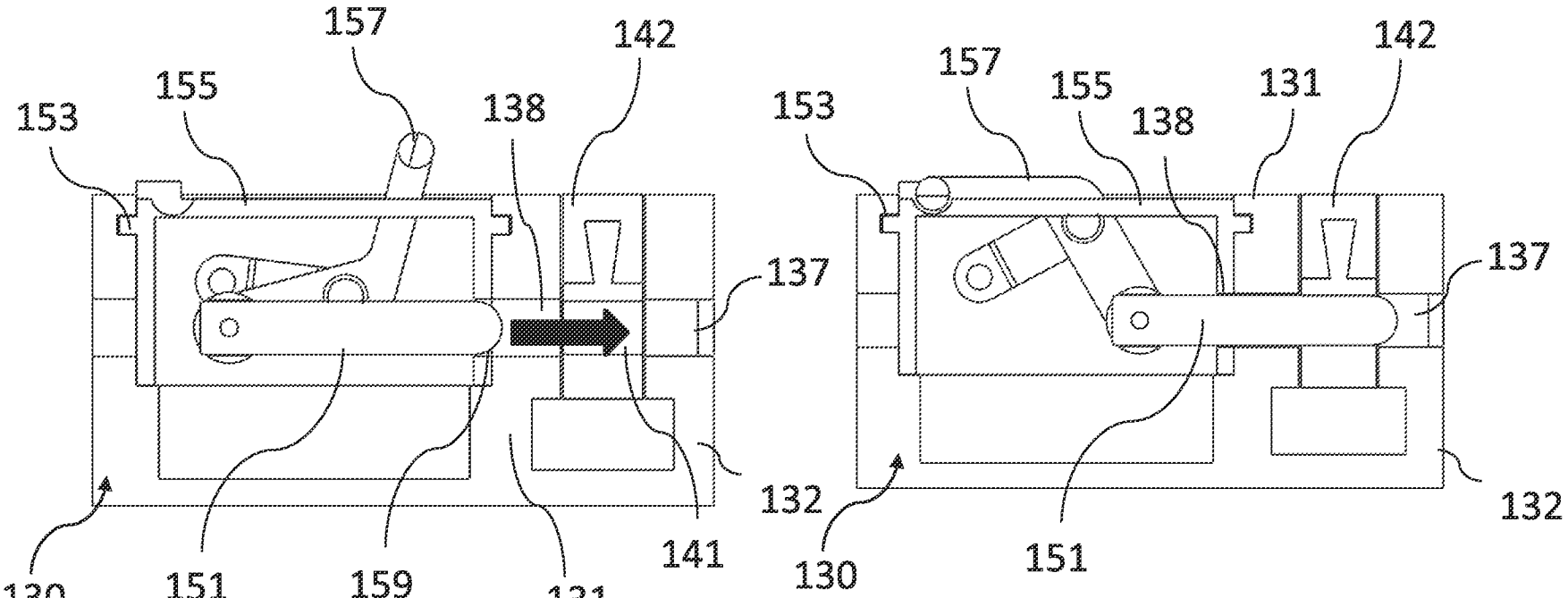

As shown in FIGS. 12A-12D, the locking assembly 150 can transition between a released configuration (FIGS. 12A and 12C) and a locked configuration (FIGS. 12B and 12D). When actuated, the actuator 157 drives the piston 151 toward or away from the adaptor 142. In the locked configuration, the piston 151 may extend out of the opening 159 in the frame 155. The piston 151 may extend through the passageway 138 in the interior wall 131 of the frame portion 130*a*, 130*b*. The piston 151 may extend through an aperture 141 in the adaptor 142 to secure the adaptor 142 to the trench frame 130. An end portion of the piston 151 may extend through the hole 137 at least partially into a hole 137 in the outer wall 132 of the frame portion 130*a*, 130*b*. The adaptor 142 may be released by reversing the steps described above.

Terminology

Although certain embodiments have been described herein with respect to hydrofoil attachments, the systems described herein can be used to attach any component to a surfboard, for example to attach one or more fins to a surfboard.

As used herein, the terms "bottom" and "top" are defined from the perspective of the surfboard in use. Thus, bottom refers to the side closer to water in use.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

Although certain embodiments and examples have been described herein, it will be understood by those skilled in the art that many aspects of the systems shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

What is claimed is:

1. A toolless attachment assembly configured to removably and securely attach a hydrofoil to a board configured for water sports, the attachment assembly comprising:

a housing; and at least one trench frame portion mounted in the housing, each trench frame portion comprising a trench for receiving a hydrofoil adaptor and a recessed portion for receiving at least one toolless locking assembly, the trench extending parallel to the recessed portion;

the at least one toolless locking assembly configured to removably and securely position the hydrofoil adaptor with respect to the at least one trench frame portion;

wherein each of the at least one toolless locking assembly comprises an actuator configured to transition said toolless locking assembly between a released configuration in which the hydrofoil adaptor can be removed from the at least one trench frame portion and a locked configuration in which the hydrofoil adaptor is secured to at least one trench frame portion;

wherein the actuator is configured to move a piston;

wherein the actuator is a lever connected to the piston by one or more linkages; and wherein in the locked configuration, the piston extends into the respective trench.

2. The attachment assembly of claim 1, wherein the at least one trench frame portion comprises a pair of trench frame portion.

3. The attachment assembly of claim 1, wherein the at least one toolless locking assembly comprises a pair of locking assemblies.

4. The attachment assembly of claim 1, wherein each of the at least one toolless locking assembly can be positioned at a plurality of positions along the recessed portion.

5. The attachment assembly of claim 1, further comprising the hydrofoil adaptor, the hydrofoil adaptor comprising a rail section configured to be disposed in the trench.

6. A toolless attachment assembly configured to removably and securely attach a hydrofoil to a board configured for water sports, the attachment assembly comprising:

a housing; and a trench frame comprising a pair of trench frame portions mounted in the housing, each trench frame portion comprising a trench for receiving a hydrofoil adaptor and a recessed portion for receiving at least one toolless locking assembly;

the hydrofoil adaptor comprising a pair of rail sections configured to be mounted in the pair of trench frame portions, the at least one toolless locking assembly comprising an actuator configured to transition between a released configuration in which the hydrofoil adaptor can be removed from the trench frame and a locked configuration in which the hydrofoil adaptor is secured to the trench frame;

wherein the actuator is configured to move a piston;

wherein the actuator is a lever connected to the piston by one or more linkages; and wherein in the locked configuration, the piston extends into the corresponding trench.

7. The attachment assembly of claim 6, wherein each of the at least one toolless locking assembly is configured to be positioned at a plurality of positions along the recessed portion.

8. The attachment assembly of claim 6, wherein the hydrofoil adaptor is configured to be positioned at multiple positions along the trench frame.

9. The attachment assembly of claim 6, wherein the trench frame portion comprises an interior wall separating the trench and the recessed portion, the interior wall comprising a passageway to permit the at least one locking assembly to extend into the trench.

* * * * *